US007267416B2

(12) United States Patent
Iriguchi

(10) Patent No.: US 7,267,416 B2
(45) Date of Patent: Sep. 11, 2007

(54) INK DROP EJECTION METHOD AND INK DROP EJECTION DEVICE

(75) Inventor: Akira Iriguchi, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 312 days.

(21) Appl. No.: 11/067,084

(22) Filed: Feb. 25, 2005

(65) Prior Publication Data

US 2005/0190221 A1 Sep. 1, 2005

(30) Foreign Application Priority Data

Feb. 27, 2004 (JP) ..... 2004-053746

(51) Int. Cl.
*B41J 29/38* (2006.01)

(52) U.S. Cl. ..... 347/9; 347/12

(58) Field of Classification Search ..... 347/9, 347/12

See application file for complete search history.

(56) References Cited

U.S. PATENT DOCUMENTS 6,575,565 B1 6/2003 Isono et al.
2005/0073537 A1* 4/2005 Iwao ..... 347/11

FOREIGN PATENT DOCUMENTS

JP 3288482 5/1995
JP 10-193587 * 7/1998
JP P-2001-162796 A 6/2001

* cited by examiner

*Primary Examiner*—Julian D. Huffman
(74) *Attorney, Agent, or Firm*—Reed Smith LLP

(57) ABSTRACT

A method of ejecting ink drops for a printing device having a plurality of nozzle arrays each including a plurality of nozzles arranged in line includes the steps of (1) delaying a timing at which the ejection pulse signals are applied for the nozzles of the nozzle arrays other than those of a reference nozzle array which is predetermined one of the plurality of nozzle arrays with respect to a timing at which the ejection pulse signals are applied for the nozzles of the reference nozzle array, and (2) delaying a timing at which the ejection pulse signals are applied for the nozzles which are to eject relatively small amount of ink drops with respect to a timing at which the ejection pulse signals are applied for the nozzles which are to eject relatively large amount of ink drops for each nozzle array.

20 Claims, 20 Drawing Sheets

FIG.12A

NO DELAYS

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 149 | |
| SMALL DROP CHANNEL | 0 | 0 | 0 | 1 | |
| LARGE DROP INFLUENCE | 300 | 300 | 300 | 298 | 1198 |
| SMALL DROP INFLUENCE | 0 | 0 | 0 | | |

FIG.12B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 149 | |
| SMALL DROP CHANNEL | 150 | 150 | 150 | 1 | |
| LARGE DROP INFLUENCE | 0 | 0 | 0 | 298 | 748 |
| SMALL DROP INFLUENCE | 150 | 150 | 150 | | |

FIG.13A

DELAY AMONG ARRAYS

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 149 | |
| SMALL DROP CHANNEL | 0 | 0 | 0 | 1 | |
| LARGE DROP INFLUENCE | 90 | 90 | 90 | 298 | 568 |
| SMALL DROP INFLUENCE | 0 | 0 | 0 | | |

FIG.13B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 149 | |
| SMALL DROP CHANNEL | 150 | 150 | 150 | 1 | |
| LARGE DROP INFLUENCE | 0 | 0 | 0 | 298 | 433 |
| SMALL DROP INFLUENCE | 45 | 45 | 45 | | |

FIG.14A

DELAYS WITHIN ARRAY

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 149 | |
| SMALL DROP CHANNEL | 0 | 0 | 0 | 1 | |
| LARGE DROP INFLUENCE | 300 | 300 | 300 | 89.4 | 989.4 |
| SMALL DROP INFLUENCE | 0 | 0 | 0 | | |

FIG.14B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 149 | |
| SMALL DROP CHANNEL | 150 | 150 | 150 | 1 | |
| LARGE DROP INFLUENCE | 0 | 0 | 0 | 89.4 | 539.4 |
| SMALL DROP INFLUENCE | 150 | 150 | 150 | | |

FIG.15A

DELAYS AMONG ARRAYS AND NOZZLES IN THE SAME ARRAY

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 149 | |
| SMALL DROP CHANNEL | 0 | 0 | 0 | 1 | |
| LARGE DROP INFLUENCE | 90 | 90 | 90 | 89.4 | 359.4 |
| SMALL DROP INFLUENCE | 0 | 0 | 0 | | |

FIG.15B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 149 | |
| SMALL DROP CHANNEL | 150 | 150 | 150 | 1 | |
| LARGE DROP INFLUENCE | 0 | 0 | 0 | 89.4 | 224.4 |
| SMALL DROP INFLUENCE | 45 | 45 | 45 | | |

FIG.16A

NO DELAYS

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 1 | |
| SMALL DROP CHANNEL | 0 | 0 | 0 | 149 | |
| LARGE DROP INFLUENCE | 300 | 300 | 300 | | 1049 |
| SMALL DROP INFLUENCE | 0 | 0 | 0 | 149 | |

FIG.16B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 1 | |
| SMALL DROP CHANNEL | 150 | 150 | 150 | 149 | |
| LARGE DROP INFLUENCE | 0 | 0 | 0 | | 599 |
| SMALL DROP INFLUENCE | 150 | 150 | 150 | 149 | |

FIG.17A

DELAYS BETWEEN ARRAYS

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 1 | |
| SMALL DROP CHANNEL | 0 | 0 | 0 | 149 | |
| LARGE DROP INFLUENCE | 90 | 90 | 90 | | 419 |
| SMALL DROP INFLUENCE | 0 | 0 | 0 | 149 | |

FIG.17B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 1 | |
| SMALL DROP CHANNEL | 150 | 150 | 150 | 149 | |
| LARGE DROP INFLUENCE | 0 | 0 | 0 | | 284 |
| SMALL DROP INFLUENCE | 45 | 45 | 45 | 149 | |

FIG.18A

DELAYS WITHIN ARRAY

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 1 | |
| SMALL DROP CHANNEL | 0 | 0 | 0 | 149 | |
| LARGE DROP INFLUENCE | 300 | 300 | 300 | | 944.7 |
| SMALL DROP INFLUENCE | 0 | 0 | 0 | 44.7 | |

FIG.18B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 1 | |
| SMALL DROP CHANNEL | 150 | 150 | 150 | 149 | |
| LARGE DROP INFLUENCE | 0 | 0 | 0 | | 494.7 |
| SMALL DROP INFLUENCE | 150 | 150 | 150 | 44.7 | |

FIG.19A

DELAYS AMONG ARRAYS AND NOZZLES IN THE SAME ARRAY

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 150 | 150 | 150 | 1 | |
| SMALL DROP CHANNEL | 0 | 0 | 0 | 149 | |
| LARGE DROP INFLUENCE | 90 | 90 | 90 | | 314.7 |
| SMALL DROP INFLUENCE | 0 | 0 | 0 | 44.7 | |

FIG.19B

| | FIRST ARRAY | SECOND ARRAY | THIRD ARRAY | FOURTH ARRAY | DEGREE OF INFLUENCE |
|---|---|---|---|---|---|
| LARGE DROP CHANNEL | 0 | 0 | 0 | 1 | |
| SMALL DROP CHANNEL | 150 | 150 | 50 | 149 | |
| LARGE DROP INFLUENCE | 0 | 0 | 0 | | 179.7 |
| SMALL DROP INFLUENCE | 45 | 45 | 45 | 44.7 | |

FIG.20

| | Example 1 | | Example 2 | | Example 3 | | Example 4 | | Example 5 | |
|---|---|---|---|---|---|---|---|---|---|---|
| | LARGE DROP | SMALL DROP | LARGE DROP | SMALL DROP | LARGE DROP | SMALL DROP | LARGE DROP | SMALL DROP | LARGE DROP | SMALL DROP |
| 1st ARRAY | 0 | 4 | 0 | 4 | 0 | 4 | 1 | 5 | 1 | 5 |
| 2nd ARRAY | 1 | 5 | 1 | 6 | 1 | 6 | 0 | 4 | 0 | 6 |
| 3rd ARRAY | 1 | 5 | 1 | 6 | 2 | 7 | 0 | 4 | 0 | 6 |
| 4th ARRAY | 1 | 5 | 1 | 6 | 3 | 8 | 1 | 5 | 1 | 7 |

(UNIT: μsec)

INK DROP EJECTION METHOD AND INK DROP EJECTION DEVICE

INCORPORATION BY REFERENCE

This application claims priority from Japanese Patent Application No. 2004-053746, filed on Feb. 27, 2004, the entire subject matter of the application is incorporated herein by reference thereto.

BACKGROUND OF THE INVENTION

The present invention relates to an ink drop ejection method and an ink drop ejection device for an inkjet printer.

Conventionally, inkjet printers have been well known and wide spread. Japanese Patent Publication No. 3288482 discloses an example of a color inkjet printer. According to this publication, the color inkjet printer has a plurality of multi-recording heads, each being provided with a plurality of recording elements (i.e., nozzles). A single power-supply belt (a flexible flat cable) is provided to supply the power to all the recording heads. In order to reduce the number of power lines embedded in a belt member to reduce load to the movement of a carriage and to the power-supply lines due to the movement of the carriage, driving voltage pulses supplied to the driven elements (nozzle heads) of, for example, cyan, magenta and yellow inks are shifted by one clock period.

U.S. Pat. No. 6,575,565 B1 discloses an on-demand inkjet printer, teachings of which are incorporated herein by reference. In the U.S. Patent, an array of a plurality of orifices (nozzles) are formed on an orifice (nozzle) plate and an array of a plurality of ink channels (pressure chambers) corresponding thereto are provided. Each of the pressure chambers are supplied with ink. On a back surface of the orifice plate, a piezoelectric actuator is provided. The piezoelectric actuator is configured such that a common electrode and individual electrodes are alternately laminated with a piezoelectric ceramics plate (i.e., a piezoelectric sheet) being sandwiched therebetween. Active portions, which are portions between opposing individual electrodes and common electrode in the laminated direction overlap, viewed from the top, above the ink channels (i.e., the pressure chambers) is provided. According to this structure, as a driving voltage is applied to each active portion of the piezoelectric actuator, the active portions deform and decrease capacity of corresponding ink channels (i.e., pressure chambers). Then, the ink inside the ink channel (pressure chamber) are ejected from the orifices (nozzles), thereby an image is printed on an object.

In the above structure, when the pressure chambers are arrayed, barrier walls are provided between adjoining pressure chambers. However, when a driving voltage is applied to an active portion of the piezoelectric actuator, deformation of the active portion exerts an influence on the adjoining pressure chamber in some degree. That is, when a plurality of nozzles are formed on the same member, mechanical vibration due to actuation of one nozzle propagates and affects another nozzle. Therefore, when an ink drop is ejected from a certain nozzle, ink drops may be ejected from the adjoining nozzles simultaneously, or ink ejection speed and/or ejection amount may be changed. Such a phenomenon in which the ink ejection conditions of nozzles interfere with each other is called crosstalk, and has been known as a problem in this field.

It should be noted that if the density of the nozzles is higher, the thickness of the barrier walls becomes thinner and thus the crosstalk occurs easily. Further, for color recording, a plurality of arrays of nozzles are arranged in one print head, and further, the clearance between the adjoining arrays is made small for downsizing, the thickness of the wall between the adjoining arrays is also decreased. Thus, the crosstalk may easily occur in such a construction.

As above, because of the need of the high density of the nozzles and downsizing of the recording heads, both the crosstalk due to the close arrangement of the pressure chambers in the same array and the crosstalk due to the close arrangement of the nozzle arrays occur.

To avoid the crosstalk, rigidity of a member surrounding the pressure chambers may be increased and/or the structure of the piezoelectric actuator may be changed as in the above-described U.S. Patent. However, if the hardware configuration is changed to increase the rigidity, manufacturing/assembling costs increase easily.

FIG. 4 of the aforementioned Japanese Patent No. 3288482 shows ejection pulses which are applied to driving terminals of respective nozzles with a certain time-lag therebetween (i.e., the ejection pulses are delayed). In FIG. 4, the width of the pulses are the same. Such a configuration implies that the amount of ink drops ejected from respective nozzles are the same.

Practically, to express gradation with the inkjet printer, the amount of the ink ejected from a nozzle is varied by changing the width of the driving pulse. By changing the width of the driving pulse, a drop of ink containing a relatively small amount of ink (which will be referred to as a small drop, hereinafter) or a drop of ink containing a relatively large amount of ink (which will be referred to a large drop, hereinafter) can be ejected. When the small drop of ink or large drop of ink is ejected, it is also necessary to impose a delay between the pulses applied to the nozzles respectively ejecting the large drop of ink and small drop of ink.

When the small drop of ink is to be ejected, a feeble pressure is applied to the pressure chamber to eject the drop of ink. If the adjoining nozzle is driven to eject a large drop of ink at the same time, a crosstalk occurs due to large energy for ejecting the large drop of ink, which crosstalk exerts an influence on the nozzle which is to eject the small drop of ink. In such a case, the nozzle which is to eject the small drop may not eject the small drop of ink having an accurate amount, or the ejection speed of the small drop may vary. Such an influence of the crosstalk is significant particularly among the pressure chambers in the same arrays.

SUMMARY OF THE INVENTION

The present invention is advantageous in that the above problem is solved by appropriately controlling the timing of ejection pulse signals.

According to an aspect of the invention, there is provided a method of ejecting ink drops for a printing device, the printing device having a plurality of nozzle arrays each including a plurality of nozzles arranged in line, a plurality of pressure chambers corresponding to each nozzle of the plurality of nozzle arrays, and a piezoelectric actuator that is driven to change a capacity of each pressure chamber filled with ink to be ejected, an ink drop being ejected from each nozzle as an ejection pulse signal is applied to the piezoelectric actuator. The method includes the steps of delaying a timing at which the ejection pulse signals are applied for the nozzles of the nozzle arrays other than those of a reference nozzle array which is predetermined one of the plurality of nozzle arrays with respect to a timing at which the ejection pulse signals are applied for the nozzles of the reference nozzle array, and delaying a timing at which the ejection pulse signals are applied for the nozzles which are to eject relatively small amount of ink drops with respect to a timing at which the ejection pulse signals are applied for the nozzles which are to eject relatively large amount of ink drops for each nozzle array.

Optionally, the reference nozzle array and the other nozzle arrays may be distinguished by viscosity of the inks to be ejected from respective nozzle arrays.

In particular, when viscosities of all the inks are equal to or more than 4.5 mPa·s, at least one of the nozzle arrays with the nozzles ejecting the ink of the highest viscosity may be selected as the reference nozzle array.

Alternatively, when viscosities of all the inks are equal to or more than 2.5 CPS, at least one of the nozzle arrays with the nozzles ejecting the ink of the lowest viscosity being selected as the reference nozzle array.

Optionally, the reference nozzle array and the other nozzle arrays may be distinguished depending on whether the nozzles of each nozzle array ejects ink containing a dye compound or ink containing pigment.

In a particular case, the nozzle array with the nozzles which eject the ink containing the pigment may be referred to as the reference nozzle array.

Further, among the nozzles each of which ejects the relatively small amount of ink, the delay for the nozzles of the nozzle array ejecting the ink containing the dye compound may be equal to or longer than the delay for the nozzles of the nozzle array ejecting the ink containing the pigment.

Still optionally, the plurality of nozzle arrays may be arranged in parallel on a single ink ejection unit, the reference nozzle array being an inner nozzle array of the parallelly arrange nozzle arrays.

Further optionally, among the nozzles of each of the nozzle arrays, a timing at which the ejection pulse signal is applied for the nozzles ejecting ink drops each having a relatively small amount of ink may be delayed with respect to a timing at which the ejection pulse signal is applied for the nozzles ejecting ink drops each having a relatively large amount of ink.

Optionally, the amount of ink ejected from each nozzle may be varied by varying a duration of a pulse of the ejection pulse signal.

Further, the method may further include a step of adding additional pulses depending on a temperature of the ink.

According to another aspect of the invention, there is provided an ink drop ejecting device for a printing device, the printing device having a plurality of nozzle arrays each including a plurality of nozzles arranged in line, a plurality of pressure chambers corresponding to each nozzle of the plurality of nozzle arrays, and a piezoelectric actuator that is driven to change a capacity of each pressure chamber filled with ink to be ejected, an ink drop being ejected from each nozzle as an ejection pulse signal is applied to the piezoelectric actuator. The ink drop ejecting device is provided with a first delaying system that delays a timing at which the ejection pulse signals are applied for the nozzles of the nozzle arrays other than those of a reference nozzle array which is predetermined one of the plurality of nozzle arrays with respect to a timing at which the ejection pulse signals are applied for the nozzles of the reference nozzle array and a second delaying system that delays a timing at which the ejection pulse signals are applied for the nozzles which are to eject relatively small amount of ink drops with respect to a timing at which the ejection pulse signals are applied for the nozzles which are to eject relatively large amount of ink drops for each nozzle array.

Optionally, the plurality of nozzle arrays may be arranged in parallel on a single ink ejection unit, the reference nozzle array being an inner nozzle array of the parallelly arrange nozzle arrays.

In a particular case, the plurality of nozzle arrays include four nozzle arrays, the reference nozzle array comprising central two nozzle arrays of the four nozzle arrays.

According to a further aspect of the invention, there is provided a computer program product comprising computer accessible instructions defining a method of ejecting ink drops for a printing device, the printing device having a plurality of nozzle arrays each including a plurality of nozzles arranged in line, a plurality of pressure chambers corresponding to each nozzle of the plurality of nozzle arrays, and a piezoelectric actuator that is driven to change a capacity of each pressure chamber filled with ink to be ejected, an ink drop being ejected from each nozzle as an ejection pulse signal is applied to the piezoelectric actuator. The program product includes the instruction of delaying a timing at which the ejection pulse signals are applied for the nozzles of the nozzle arrays other than those of a reference nozzle array which is predetermined one of the plurality of nozzle arrays with respect to a timing at which the ejection pulse signals are applied for the nozzles of the reference nozzle array, delaying a timing at which the ejection pulse signals are applied for the nozzles which are to eject relatively small amount of ink drops with respect to a timing at which the ejection pulse signals are applied for the nozzles which are to eject relatively large amount of ink drops for each nozzle array.

Optionally, the reference nozzle array and the other nozzle arrays may be distinguished by viscosity of the inks to be ejected from respective nozzle arrays.

Further, when viscosities of all the inks are equal to or more than 4.5 mPa·s, at least one of the nozzle arrays with the nozzles ejecting the ink of the highest viscosity being selected as the reference nozzle array.

Alternatively, when viscosities of all the inks are equal to or more than 2.5 CPS, at least one of the nozzle arrays with the nozzles ejecting the ink of the lowest viscosity being selected as the reference nozzle array.

Still optionally, the reference nozzle array and the other nozzle arrays may be distinguished depending on whether the nozzles of each nozzle array ejects ink containing a dye compound or ink containing pigment.

Further, the nozzle array with the nozzles which eject the ink containing the pigment may be referred to as the reference nozzle array.

BRIEF DESCRIPTION OF THE ACCOMPANYING DRAWINGS

Figure 9:
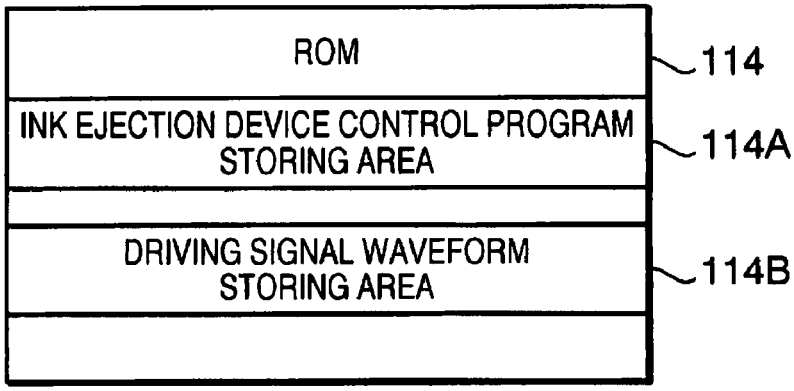
Figure 10:
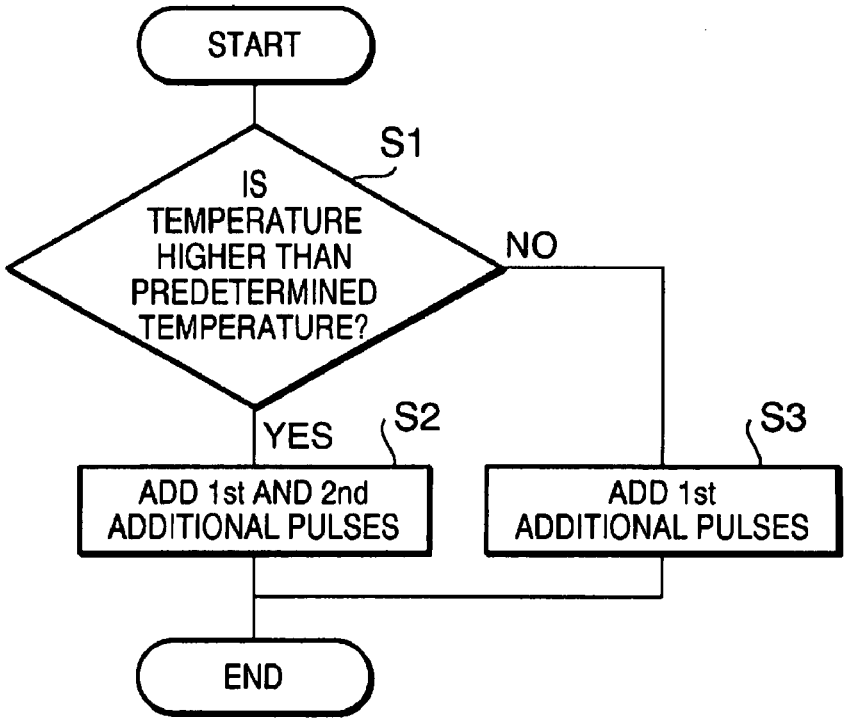
Figure 11:
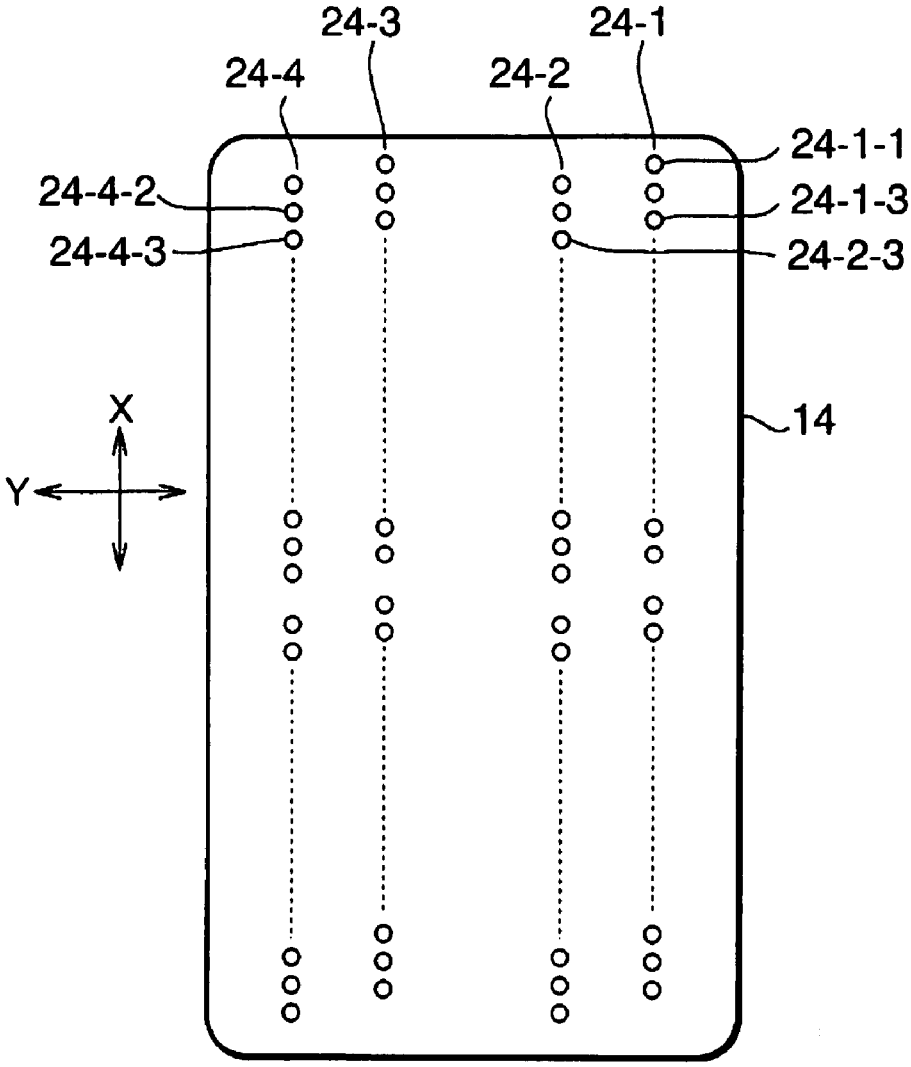

FIG. 9 schematically shows storing areas of a ROM of a control circuit of the ink drop ejecting device;

FIG. 10 is a flowchart illustrating a ROM control procedure of the control device of the ink drop ejecting device;

FIG. 11 is a plan view of a nozzle plate:

FIGS. 12A and 12B are tables showing effects of crosstalk;

FIGS. 13A and 13B are tables showing effects of crosstalk;

FIGS. 14A and 14B are tables showing effects of crosstalk;

FIGS. 15A and 15B are tables showing effects of crosstalk;

FIGS. 16A and 16B are tables showing effects of crosstalk;

FIGS. 17A and 17B are tables showing effects of crosstalk;

FIGS. 18A and 18B are tables showing effects of crosstalk;

FIGS. 19A and 19B are tables showing effects of crosstalk;

FIG. 20 is a table showing delaying periods;

FIGS. 21A-21D are timing charts showing the pulse signals (driving waveforms) according to the ink drop ejection method; and FIGS. 22A-22D are timing charts showing the pulse signals (driving waveforms) according to another embodiment of the ink drop ejection method.

DETAILED DESCRIPTION OF THE EMBODIMENTS

Referring to the accompanying drawings, ink drop ejection devices according to embodiments of the invention will be described in detail.

Figure 1:
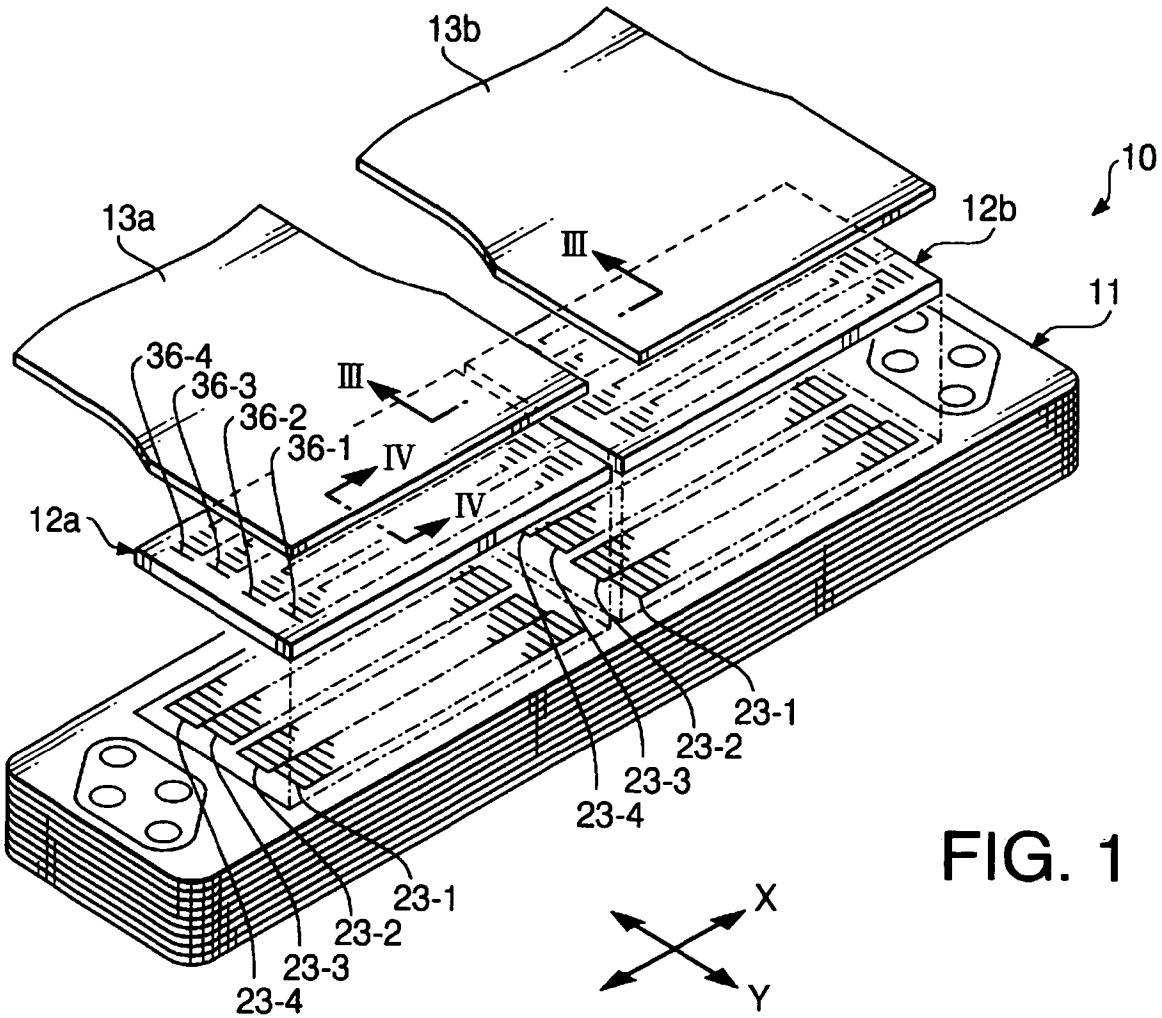
FIG. 1 is an exploded perspective view of a cavity unit, a piezoelectric actuator and a flat cable of a piezoelectric inkjet printer according to a first embodiment.

FIG. 1 is an exploded perspective view of a cavity unit 11, piezoelectric actuators 12*a* and 12*b* (occasionally represented by 12) and flat cables 13*a* and 13*b* (occasionally referred to as 13) of a piezoelectric inkjet printer head 10 employing an ink drop ejection device according to a first embodiment of the invention.

The inkjet printer head 10 is configured such that plate-laminated type piezoelectric actuators 12*a* and 12*b* are secured on the cavity unit 11 made of metal plate. On the top surfaces of the piezoelectric actuators 12*a* and 12*b*, the flexible cables 13*a* and 13*b* are soldered. The flexible cables 13*a* and 13*b* are connected with an external device and transmit image data and head driving signal.

Figure 2:
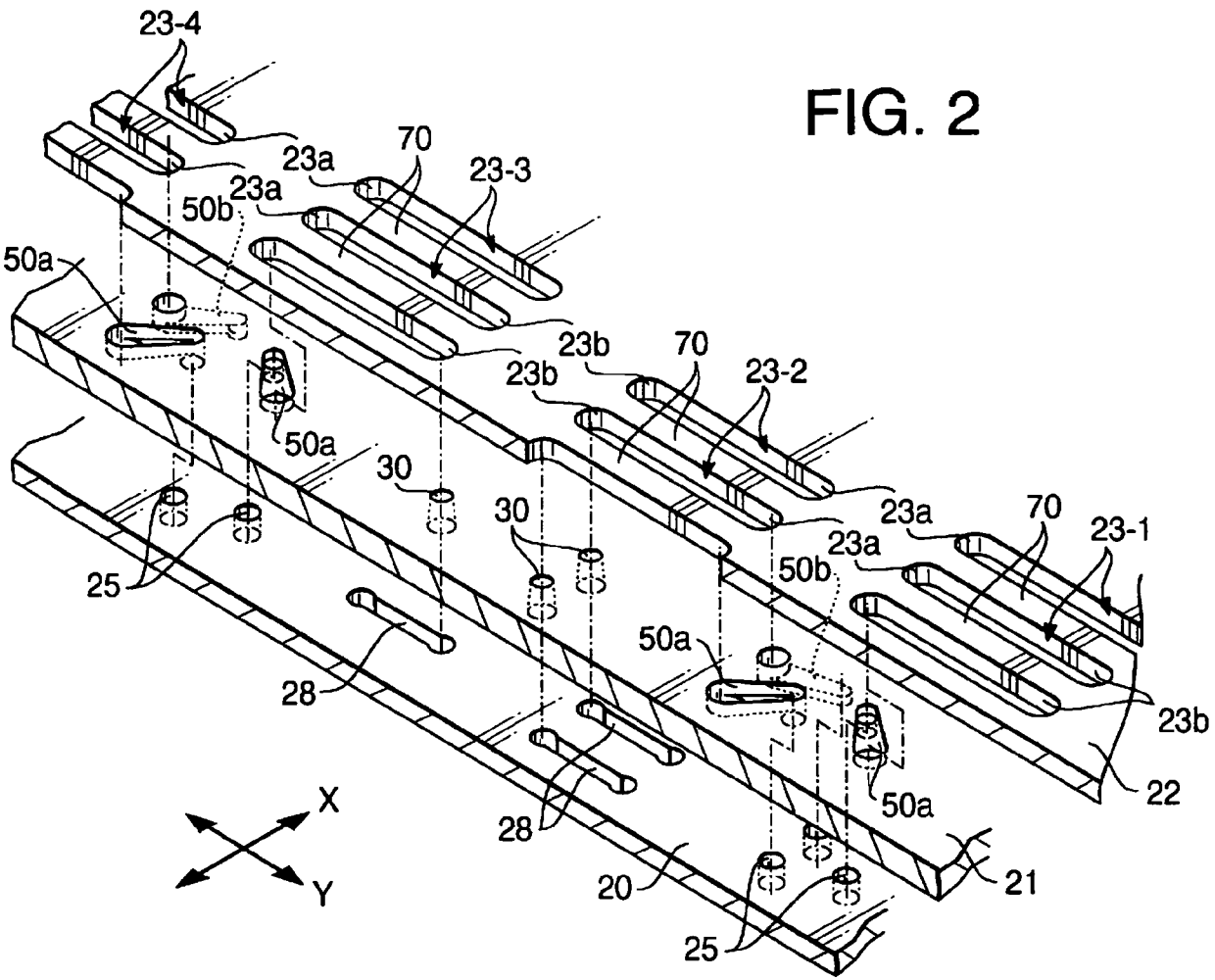
FIG. 2 is a perspective view of a part of the cavity unit shown in FIG. 1.
Figure 3:
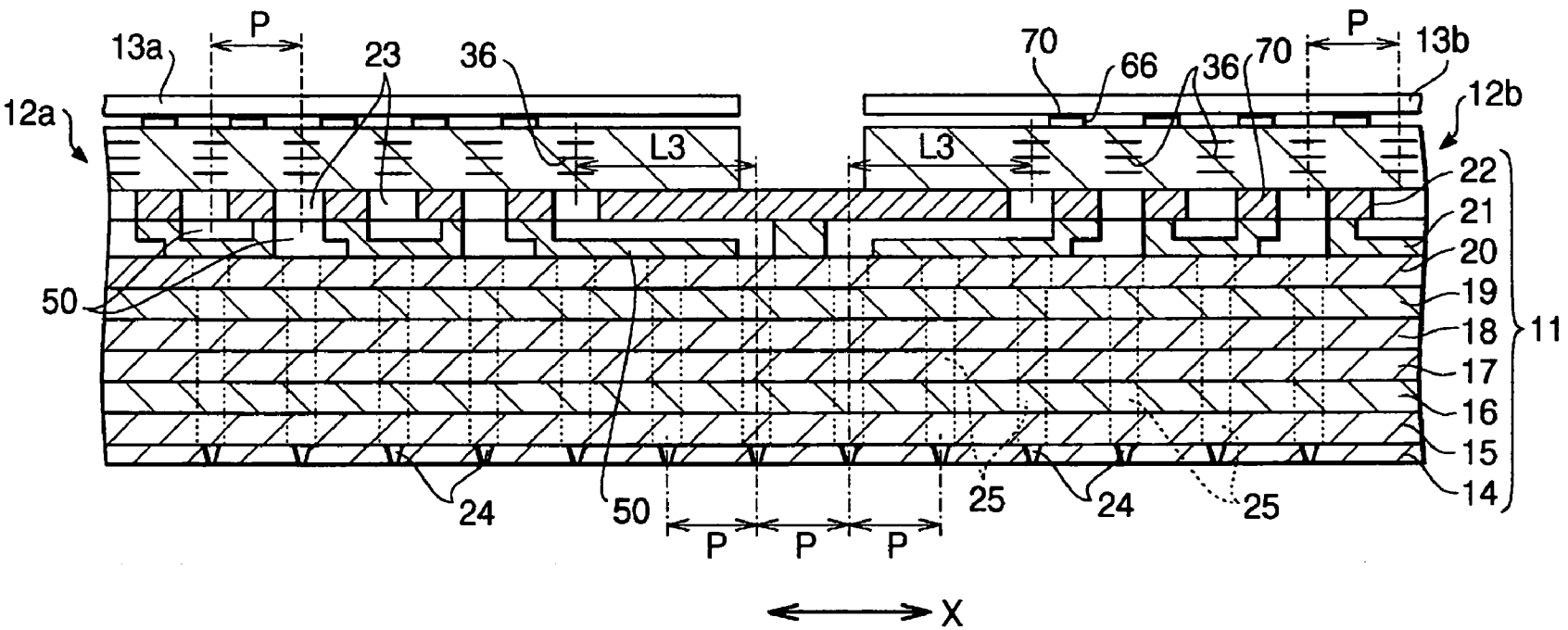
FIG. 3 is an enlarged cross sectional view taken along line III-III of FIG. 1.

FIG. 2 is a perspective view of a part of the cavity unit 11 shown in FIG. 1. FIG. 3 is an enlarged cross sectional view of the cavity unit 11, taken along line II-III of FIG. 1, and FIG. 4 is an enlarged cross sectional view of the cavity unit 11 taken along line IV-IV of FIG. 1.

The cavity unit 11 has a laminated structure having nine thin plates: a nozzle plate 14; a cover plate 15, a damper plate 16, two manifold plates 17 and 18; three spacer plates 19, 20 and 21; and a pressure plate 23, which are laminated and adhered with adhesive agent in this order from the bottom to top. In this exemplary embodiment, the nozzle plate 14 is made of synthetic resin and of the plates 15 through 22 is made of 42% nickel alloy steel plate. Each of the laminated plates 14 through 22 has a thickness within a range of 50 μm through 150 μm.

The nozzle plate 14 is formed with a plurality of ink ejection nozzles 24. Each nozzle 24 has a minute diameter (25 μm in this embodiment). Hereinafter, a direction parallel to a longer side of the cavity unit 11 will be referred to as an X direction or first direction, and a direction parallel to a shorter side of the cavity unit 11 will be referred to as a Y direction (see FIGS. 1 and 3) or a second direction. The plurality of nozzles 24 are arranged such that four arrays of nozzles, each array extending in the first direction, are aligned in the second direction. FIG. 11 show a plan view of the nozzle plate 14. As shown in FIG. 11, the two adjoining arrays of nozzles 24 are slightly shifted in the first direction so that the nozzles 24 of the adjoining two arrays exhibit a hound's-tooth (zigzag) arrangement pattern.

Figure 4:
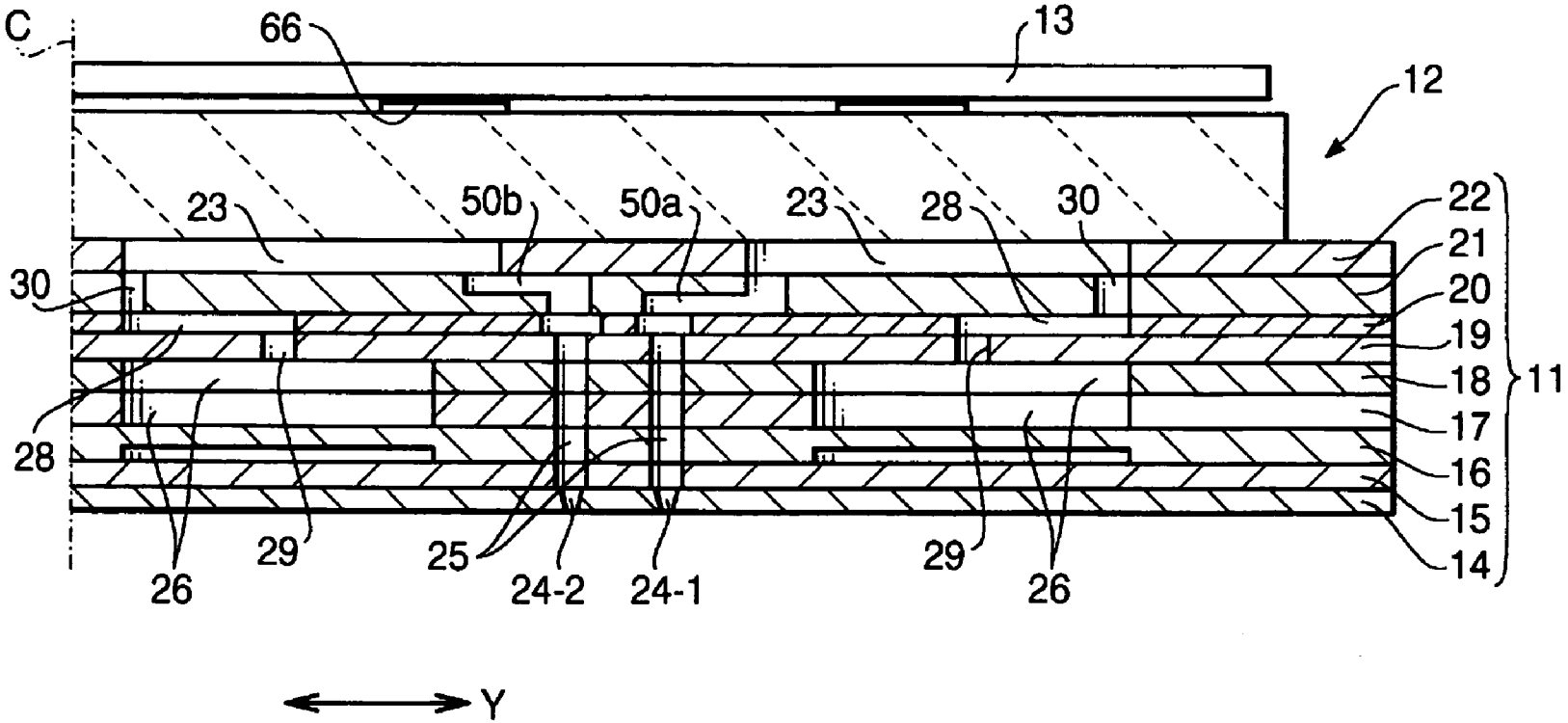
FIG. 4 is an enlarged cross sectional view taken along line IV-IV of FIG. 1.

In FIG. 4, which is a right-hand side half with respect to a central line C of a cross section of the cavity unit 11 cut in the Y direction, a first nozzle array 24-1 on the right-hand side and a second nozzle array 24-2 on the center line side are aligned along two parallel reference lines extending in the X direction (see FIG. 11). Similarly, a third nozzle array 24-3 and a fourth nozzle array 24-4 are aligned along two parallel reference lines extending in the X direction. The nozzles 24 in each array are arranged at a minute pitch P. The first nozzle array 24-1 and the second nozzle array 24-2 are arranged in parallel with and spaced from each other. Similarly, the third nozzle array 24-3 and the fourth nozzle array 24-4 are arranged parallel with and spaced form each other. According to the embodiment, the length of each of the first through fourth nozzle arrays is 2 inches, and the number of nozzles in each nozzle array is 140. Therefore, the density of the nozzle arrangement is 75 dpi (dots per inch) in this example.

On the base plate 22 which is the top-most surface of the cavity unit 11, a plurality of pressure chambers are formed. Specifically, a plurality of arrays of pressure chambers are arranged such that, as shown in FIG. 2, first array 23-1, second array 23-2, third array 23-3, fourth array 234 of the pressure chambers correspond to first array 24-1, second array 24-2, third array 24-3 and fourth array 24-4 of the nozzles, respectively.

Next, the arrangement of the pressure chambers in the base plate 22 will be described in detail together with the arrangement of the active portions of the two piezoelectric actuators 12 (12*a* and 12*b*).

Each piezoelectric actuator 12*a* (12*b*) is arranged to have 75 active portions that actuate a half of the pressure chambers 23 in the array direction (i.e., 75 for each of the arrays 23-1, 23-2, 23-3 and 234). Thus, as shown in FIG. 1 and FIG. 3, on one half (i.e., front half) of the top surface of the cavity unit 11, in the X direction, one piezoelectric actuator 12*a* is arranged, and on the other half (i.e., rear half) of the top surface of the cavity unit 11, another piezoelectric actuator 12*b* is arranged.

Each piezoelectric actuator 12*a* (12*g*) is configure such that common electrodes 37 and individual electrodes 36 located at positions corresponding to the pressure chambers are alternately laminated (as will be described in detail) with piezoelectric sheets nipped therebetween. When a voltage between desired individual electrodes 36 and the common electrode 37, the active portion of the piezoelectric sheet corresponding to the individual electrode 36 to which the voltage applied is distorted due to longitudinal piezoelectric effect in the laminated direction. It should be noted that the number of the active portions is the same as the number of the pressure chambers 23 in each array, and are located at positions corresponding to the positions of the pressure chambers.

That is, the active portions are aligned in the first direction (i.e., the direction of the arrays of nozzles 24 or pressure chambers 23), the number of arrays of the active portions being the same as the number of arrays of the nozzle arrays (i.e., four, in this embodiment) in the second direction. Each active portion is formed to be elongated in the second direction along the longitudinal direction of the pressure chamber 23. The clearance (i.e., a pitch) between the adjoining active portions is similar to that of the pressure chambers 23. Further, similarly to the pressure chambers 23, the active portions are arranged to exhibit a hound's-tooth (zigzag) arrangement pattern.

The pressure chambers 23 are categorized in two groups which are divided in the longitudinal direction of the base plate 22, corresponding to the two piezoelectric actuators 12*a* and 12*b*. That is, as shown in FIG. 3, the pressure chambers 23 in a group corresponding to the actuator 12*a* also correspond to the nozzles on the front side, while the pressure chambers 23 of the group corresponding to the other actuator 12*b* correspond to the nozzles on the rear side. In a direction of the aligned array, the pressure chambers are arranged at the same interval (P) as the arrangement of the nozzles 24. Further, similarly to the nozzles, the pressure chambers 23 are arranged in two pairs of arrays (i.e., four arrays), each pair exhibit the hound's-tooth (zigzag) arrangement pattern.

Each pressure chamber 23 is elongated in the width direction (i.e., second direction) of the base plate 22, and is formed as a through opening which is pierced through the base palate in its thickness direction. Adjoining pressure chambers 23 are separated by a barrier wall 70 therebetween. An inlet end 23*b* of each pressure chamber 23 communicates with a manifold chamber 26 via a first ink passage 29, a throttle portion 28 and a second ink passage 30 formed in the spacer plates 19, 20 and 21, respectively (see FIGS. 2 and 4).

An outlet end 23*a* of each pressure chamber 23 communicates with the corresponding nozzle 24 via ink passage 25 formed in the spacer plates 19, 20 and 21, manifold plates 17 and 18, damper plate 16 and cover plate 15, which are sandwiched between the based plate 22 and the nozzle plate 14.

As shown in FIG. 2, the ink passage 25 includes a groove passages 50 (50*a* and 50*b*) on at least one plate among the plates 15 through 21 laminated between the base plate 22 and the nozzle plate 14. Each groove passage 50 (50*a* or 50*b*) extends substantially parallel with the wide surface (i.e., the upper or lower surface of the plate). With this structure, the nozzle 24 can be formed at a position shifted from an intersecting position at which a perpendicular line, to the base plate 22, drawn from the outlet end 23*a* of the pressure chamber 23 intersects with the nozzle plate 14 by a distance L3 in the first direction (i.e., X direction) (see FIGS. 2 and 3).

Figure 5:
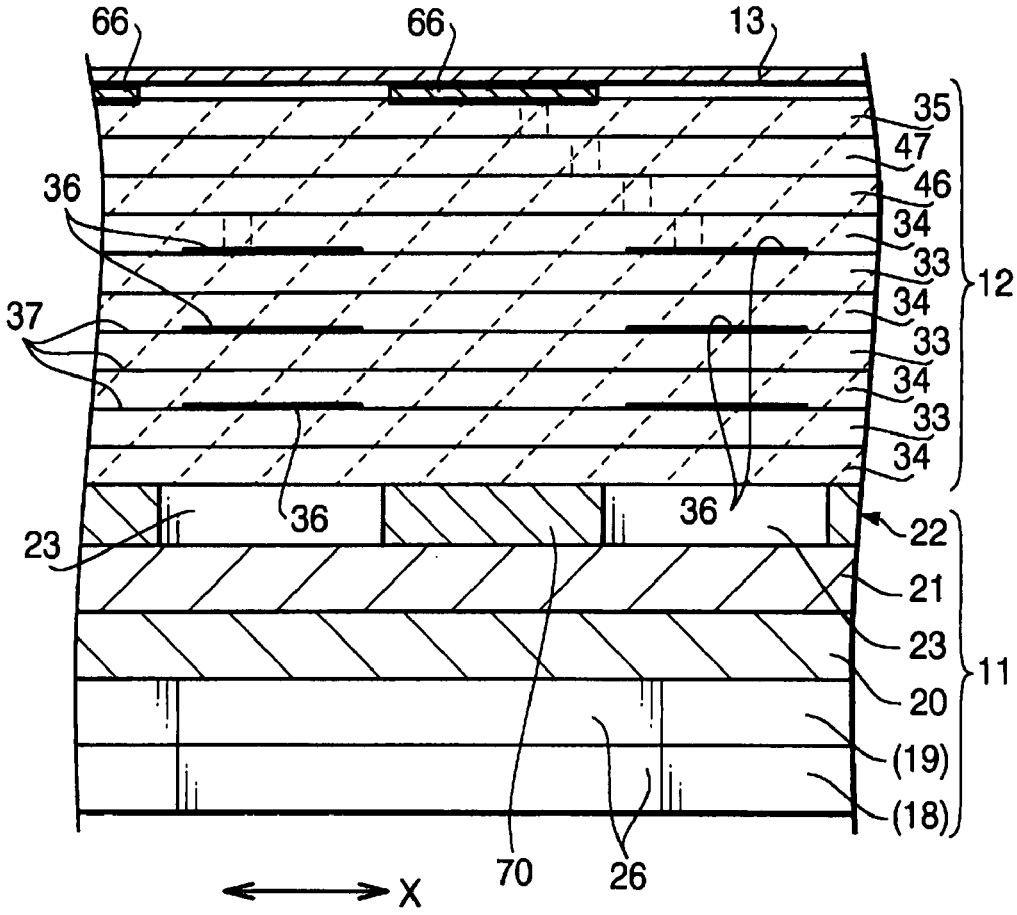
FIG. 5 is a partially enlarged cross sectional view of the piezoelectric actuator.

A structure of the piezoelectric actuator 12 is shown in FIG. 5. Each piezoelectric actuator 12 has a group of piezoelectric sheets 33 and 34. The group of piezoelectric sheets 33 and 34 is configured such that a plurality of (seven, in this embodiment) piezoelectric sheets 33 and 34 are alternately laminated. Each of the piezoelectric sheets 33 and 34 is a piezoelectric ceramic plate having a thickness of approximately 30 μm. On the upper surface of the group of piezoelectric sheets 33 and 34, a constrained layer consisting of two sheets 46 and 47 is laminated. Further, on the upper surface of the constrained layer (i.e., upper surface of the sheet 47), a top sheet 35 is laminated. The sheets 46 and 47 of the constrained layer and the top sheet 35 can be made of any material having electrical conductivity, and can be piezoelectric ceramic plates.

On the upper surfaces of the piezoelectric sheets 34 of odd turn counting from the lowermost piezoelectric sheet 34, common electrode 37 are provided, and on the upper surfaces of the piezoelectric sheets 33 or even turn, individual electrodes 36 are arranged at positions corresponding to the pressure chambers 23 in the cavity unit 11. The individual electrodes 36, common electrodes 37, and piezoelectric sheets 33 and 34 sandwiched between the electrodes 36 and 37 constitute the active portions. Each individual electrode 36 has substantially the same outer shape, in plan view, as the corresponding pressure chamber 23. Each individual electrode 36 has an elongated shape in parallel with the shorter side of each piezoelectric sheet 33. Corresponding to the pressure chambers 23, four arrays (36-1, 36-2, 36-3 and 36-4) of individual electrodes 36 are arranged, each array includes a plurality of (75) individual electrodes arranged along the X direction. Further, as shown in FIG. 1, the individual electrode arrays 36-1, 36-2, 36-3 and 36-4 are arranged in the Y direction.

The first array 36-1 and the fourth array 364 of the individual electrodes 36 are arranged on the outer side, in the Y direction, (closer to the longer sides) of the piezoelectric sheet 33, while the second array 36-2 and third array 36-3 are arranged on the central side, in the Y direction, of the piezoelectric sheet 33.

With this configuration, by applying a high voltage across the common electrodes 37 and all the individual electrodes 36 via the individual connection electrodes 66 and common connection electrode, portions of the piezoelectric sheets 33 and 34 sandwiched between the individual electrodes 36 and the common electrode 37 are polarized. The polarized portions of the piezoelectric sheets 33 and 34 sandwiched between the individual electrodes 36 and the common electrode 37 serve as active portions. In this condition, when a driving voltage is applied to desired individual electrodes 36 and common electrodes 37 via the individual connection electrodes 66 and common connection electrode to generate electric fields in the polarization direction of the corresponding active portions, the active portions are elongated in the laminated direction, thereby the capacities of corresponding pressure chambers 23 are reduced and the ink in each of the pressure chambers 23 is ejected as an ink drop from the corresponding nozzle 24 and form an printed image on an object.

When color printing is performed using four color inks (black, cyan, yellow and magenta inks), for example, the first nozzle array 24-1 is used for ejecting the black ink, the second nozzle array 24-2 is used for ejecting the cyan ink, third nozzle array 24-3 is used for ejecting the yellow ink and the fourth nozzle array 24-4 is used for ejecting the magenta ink. In such a case, corresponding to the colors assigned to the nozzle arrays, in a first array of manifold chambers 26, the black ink is filled, the cyan ink is filled in a second manifold chambers 26, the yellow ink is filled in a third manifold chambers 26, and the magenta ink is filled in the fourth manifold chambers 26.

Figure 6:
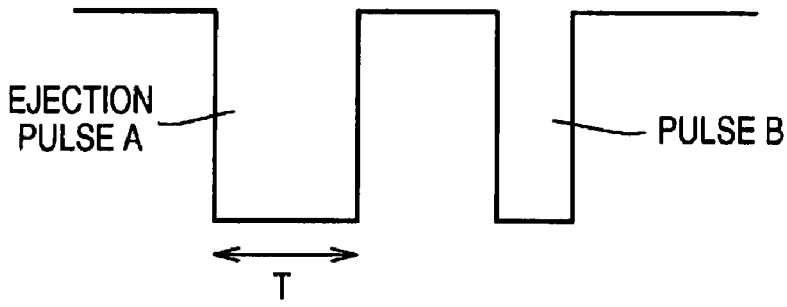
FIG. 6 is a chart showing a driving pulse signal (driving waveform) for forming an ink drop.

Next, waveforms of driving pulse signals applied to the individual electrodes 26 and the common electrodes 37 will be described. FIG. 6 is a chart showing a driving pulse signal for forming an ink drop to print one dot of image. The driving pulse signal includes an ejection pulse A for ejecting an ink drop, and an additional pulse B which is a non-ejection signal having width less than that of the pulse A and is added at a timing so that a part of the ink drop being ejected is pulled back. The amplitude (i.e., voltage value) of the ejection pulse A and additional pulse B are the same (e.g., 20 V).

Figure 7:
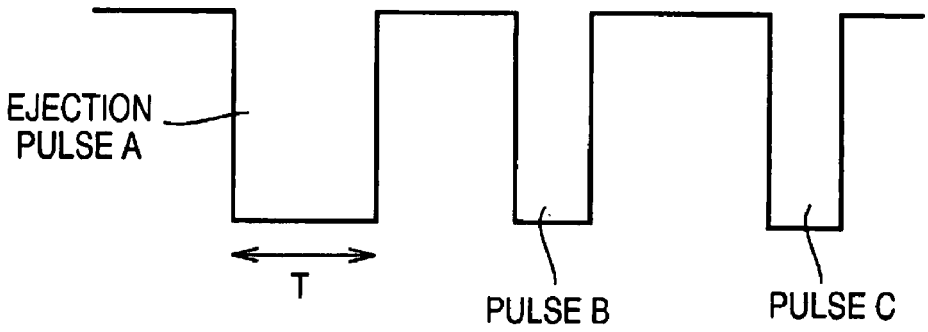
FIG. 7 is a chart showing a driving pulse signal (driving waveform) for forming an ink drop.

FIG. 7 is a chart showing an improved driving pulse signal (driving waveform) for forming an ink drop. The pulse signal shown in FIG. 7 includes the ejection pulse A and the additional pulse B, which are similar to those shown in FIG. 6. The signal shown in FIG. 7 further includes a second additional pulse C which is also a non-ejection pulse and for stabilizing the ejection of the ink. By adding the second additional pulse C, unstable ejection which typically occurs when the viscosity of the ink is relatively low. It should be noted that, when the duration T of the ejection pulse A is long, the large ink drop is ejected from the corresponding nozzle (that is, the ejection amount of the ink is increased), while the small ink drop is formed (i.e., the amount of the ejected ink is decreased) when the duration T is relatively short.

Figure 8:
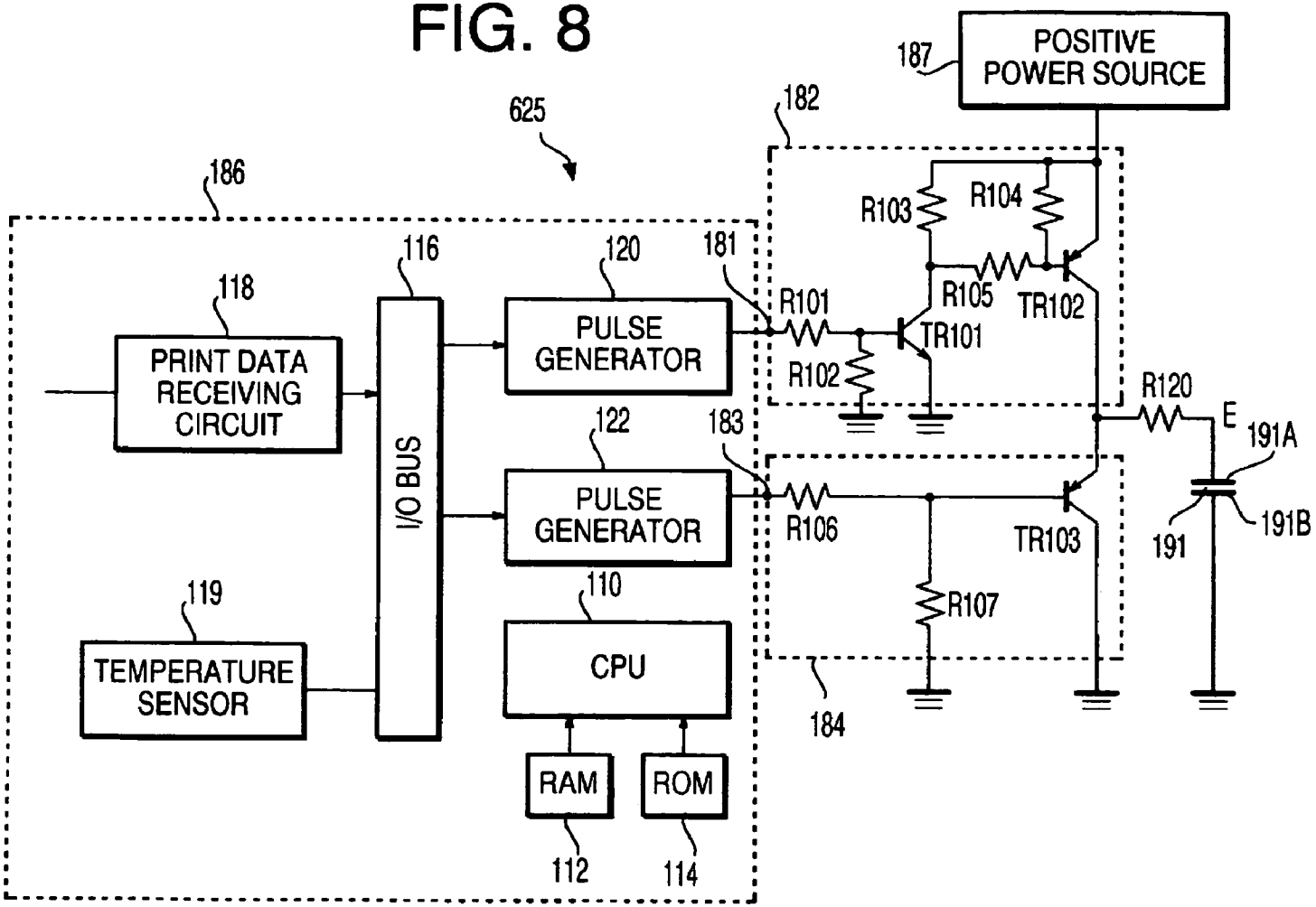
FIG. 8 is a circuit diagram showing a driving circuit of an ink drop ejecting device.

Next, a control device for realizing the above-described driving pulse signal will be described. FIG. 8 is a circuit diagram showing a control device 625 of the ink drop ejecting device.

The control device 625 includes a charging circuit 182, a discharging circuit 184 and a pulse control circuit 186. In FIG. 8, the active portion (including the individual electrode 36 and the common electrode 37) of the piezoelectric actuator 12 is represented, as an equivalent, by a condenser 191. Numerals 191A and 191B represent the terminals of the condenser 191.

The charging circuit 182 has input terminals 181 and 183. By inputting a pulse signal to the input terminals 181 and 183, the voltage applied to the electrodes (in FIG. 8, the terminals 191A and 191B of the condenser 191) is set to E (V) or 0 (V), respectively. The charging circuit 182 further includes resistors R101, R102, R103, R104 and R105, and transistors TR101 and TR102.

When an ON signal (+5 V) is applied to the input terminal 181, the transistor TR101 is turned ON, and a electrical current flows from a positive power source 187 to the emitter of the transistor TR101 via the resistor R103 and the collector of the transistor TR101. Then divided voltages across the resistors R104 and R105, which are connected to the positive power source 187, increase, and the electrical current flowing through the base of the transistor TR102 increase. Then, the transistor TR102 turns ON and, from the positive power source 187, a positive voltage of 20 V is applied to the terminal 191A of the condenser 191 via the collector and emitter of the transistor TR102 and the resistor R120. As the voltage (20 V) is applied, electrical charges are accumulated in the condenser 191 according to the electrostatic capacity thereof.

The discharging circuit 184 includes the resistors R106 and R107, and the transistor TR107. When the ON signal (+5V) is applied to the input terminal 183, a voltage divided by the resistors R106 and R107 is applied to the base of the transistor TR103. Then, the transistor TR103 is turned ON, and the terminal 191A of the condenser 191 is grounded via the resistor R120. As the terminal 191A is grounded, the active portions corresponding to the individual electrodes 36 and the common electrodes 37 (which is represented by the condenser 191 in FIG. 8) are discharged.

Next, the pulse control circuit 186 which generates a pulse signal input to the input terminal 181 of the charging circuit 182 and the input terminal 183 of the discharging circuit 193 will be described. As shown in FIG. 8, the pulse control circuit 186 includes a CPU 110 which performs various operational procedures. To the CPU 110, a RAM 112 for storing print data and various other data, and a ROM 114 for storing a control program and sequence data that enables the pulse control circuit 186 to output ON/OFF signals at predetermined timings.

FIG. 9 schematically shows storing areas of the ROM 114 of the pulse control circuit 186 shown in FIG. 8. As shown in FIG. 9, the ROM 114 includes an ink drop ejection control program storing area 114A and a driving waveform data storing area 114B. The aforementioned sequence data of the driving waveform is stored in the driving waveform data storing area 114B.

The CPU 110 is connected with an I/O (input/output) bus 116, to which a print data receiving circuit 118, and pulse generator 120 and 122 are connected. The output of the pulse generator 120 is applied to the input terminal 181 of the charging circuit 182, and the output of the pulse generator 1222 is applied to the input terminal 183 of the discharging circuit 184.

The pulse control circuit 186 further includes a temperature sensor 119 that detects the temperature of the ink. According to this embodiment, the temperature sensor 119 indirectly detects the temperature of the ink by detecting the ambient air temperature. The temperature sensor 119 is connected to the I/O bus 116, through which the CPU 110 obtains the detected temperature.

FIG. 10 shows a program module illustrating selection of additional pulses to be executed by the CPU 110, which program module is stored in the control program storing area 114A. In S1, control judges whether the temperature of the ink is equal to or greater than a predetermined temperature. If the temperature is lower than the predetermined temperature (S1: NO), control determines that only the first additional pulse A is added to the ejection pulse A (see FIG. 6). If the temperature is equal to or higher than the predetermined temperature (S1: YES), control determines that the first and second additional pulses B and C (see FIG. 7) are added to the ejection pulse A. With this control, if the temperature is relatively high and the viscosity of the ink is lowered, the ink drop can be ejected stably. It should be noted that the additional pulses A and B are stored in the waveform data storing area 114B together with the ejection pulse A.

The CPU 110 controls the pulse generators 120 and 122 in accordance with the sequence data stored in the waveform data storing area 114B of the ROM 114. That is, various patterns of pulse signals such as one shown in FIGS. 6 and 7 are stored in the waveform data storing area 114B, and thus, the CPU 110 can control the pulse generators 120 and 122 easily by referring to the stored pattern.

It should be noted that the number of the pulse generators 120 and 122, charging circuit 182 and discharging circuit 184 is the same of the number of the nozzles 24. In the above description, the control device 625 corresponding to one nozzle 24 is described. The other control devices for respective nozzles operate similarly.

The first embodiment is intended to suppress the crosstalk among the nozzles by controlling the output timing of the ejection pulse A, thereby forming ink drops having accurate ink ejection amounts. Specifically, in the first embodiment, for the nozzles of different nozzle arrays 24-1, 24-2, 24-3 and 24-4, the timing of the ejection pulse A is differentiated. Further, for the nozzles 24 of the same array, the timing of the ejection pulse is differentiated depending on whether the large ink drop is to be ejected or the small ink drop is to be ejected.

The above control will be described in detail. As shown in FIG. 11, each of the first nozzle array 24-1, second nozzle array 24-2, third nozzle array 24-3 and fourth nozzle array 24-4, 150 nozzles 24 are aligned in the X direction. When the inkjet head is driven to eject the ink, the ejection timing of the ink from a nozzle is controlled in accordance with the array to which the nozzle belongs, and the amount of the ink to be ejected from the nozzle. For all the nozzles, such a control is executed to execute the printing operation.

Now, an example will be presented below referring to the ejection of the ink from a nozzle 24-1-1 that belongs to the first nozzle array 24-1 and from another nozzle 24-2-3 that belongs to the nozzle array 24-2. According to the embodiment, a timing at which the ejection pulse A is applied for the nozzle 24-1-1 and a timing at which the ejection pulse A is applied for the nozzle 24-2-3 are shifted (i.e., a delay is provided between the timings when the ejection pulses A are applied). Since the two nozzles belong to different nozzle arrays, the timings of the ejection pulses A are shifted.

Further, a case when two nozzle eject different amounts of ink will be described referring to the ejection of the ink from the nozzle 24-1-1 and a nozzle 24-1-3, which belong to the same nozzle array 24-1. When an ejection pulse A having a relatively short duration T2 is applied for the nozzle 24-1-1 so that the small ink drop is ejected therefrom, and an ejection pulse A having a relatively long duration T1 is applied to the nozzle 24-1-3 so that the large ink drop is ejected therefrom, the timings when the both pulses A are applied are shifted (i.e., a delay is introduced).

Since the pressure chambers 23 corresponding to the nozzles 24 are formed in the same base plate 22, when the ink drops are ejected from the nozzles as the piezoelectric actuator 12 is driven, the piezoelectric actuator 12 is distorted and the base plate 22 is also deformed as it receives the pressure from the piezoelectric actuator 12. The distortion and/or deformation is propagated to adjoining pressure chambers 23. In such a case, the ink drops may not be ejected accurately from the nozzles which receive such a force. Such a condition is in particular problematic for the nozzles which are to eject the small ink drops (i.e., the amount of ejected ink is relatively small).

If the timings at which the ejection pulses A are applied are shifted as described above, the timings of pressure waves which have influence on the pressure chambers 23 are shifted and the ink drops may be ejected from respective nozzles accurately. That is, the influence of the crosstalk among the nozzles 24 can be suppressed.

As in the above control, with respect to the timing for applying the ejection pulses A to the nozzles 24 in one of the four arrays of nozzles, if the timings of the ejection pulses A to the other nozzle arrays are shifted (delayed), respectively, the influence of crosstalk among the nozzles of different arrays can be suppressed. Similarly, if the timings of the ejection pulses A to the other nozzles are shifted (delayed), respectively, with respect to the timing for applying the ejection pulse A to a nozzle 24 in the same array, the influence of the crosstalk among the nozzles in the same array can be suppressed.

FIGS. 12A and 12B, FIGS. 13A and 13B, FIGS. 14A and 14B and FIGS. 15A and 15B are tables showing the influence of crosstalk on a nozzle 24-4-3 which ejects the small ink drop when only the nozzle 24-4-3 of the fourth nozzle array 24-4 ejects the small ink drop, and the remaining 149 channels of nozzles of the same array (i.e., fourth array 24-4) eject the large ink drops under various conditions. In each table, the degree of the influence on the notice channel (i.e., the nozzle 24-4-3) receives is represented by numbers. In FIGS. 12A through 15B, the influence of the crosstalk when only one nozzle 24-4-3 of the fourth nozzle array 24-4 ejects the small ink drop and the other 149 nozzles of the fourth nozzle array 244 eject the large ink drops is indicated. Further, FIGS. 12A, 13A, 14A and 15A indicate the influence when all the nozzles of the first nozzle array 24-1 through third nozzle array 24-3 eject the large ink drops, while FIGS. 12B, 13B, 14B and 15B indicate the influence when all the nozzles of the first nozzle array 24-1 through third nozzle array 24-3 eject the small ink drops FIGS. 12A and 12B show the influence when no delays are introduced between the pulse for the nozzle 24-4-3 (1ch) and the pulses for the other 149 nozzles (149 ch) of the fourth nozzle array 24-4. Between the pulse for the nozzle 24-4-3 and the pulses for all the nozzles in the first nozzle array 24-1 through the third nozzle array 24-3, no delays are introduced either.

FIGS. 13A and 13B show the influence when a delay is introduced between the pulse for the nozzle 24-4-3 and all the pulses for the nozzles in the first nozzle array 24-1 through the third nozzle array 24-3. No delays are introduced between the pulse for the nozzle 24-4-3 and the pulses for the other nozzles in the same nozzle array 24-4.

FIGS. 14A and 14B show the influence when a delay is introduced between the pulse for the nozzle 24-4-3 and the pulses for the other 149 nozzles of the fourth nozzle array 24-4, while no delays are introduced between the pulse for the nozzle 24-4-3 and the pulses for all the nozzles in the first nozzle array 24-1 through the third nozzle array 24-3.

FIGS. 15A and 15B show the influence when a delay is introduced between the pulse for the nozzle 24-4-3 and the pulses for the other 149 nozzles of the fourth nozzle array 24-4, and between the pulse for the nozzle 24-4-3 and the pulses for all the nozzles in the first nozzle array 24-1 through the third nozzle array 24-3.

The degree of the influence indicated in FIGS. 12A through 15B is defined as follows.

(1) With respect to one notice nozzle (e.g., in FIGS. 12-15, the nozzle 24-1-3 of the fourth nozzle array), when the other nozzles 24 eject the small ink drops, the influence on the notice nozzle due to the crosstalk, the degree of the influence is one.

(2) When the nozzles 24 other than the notice nozzle eject the large ink drops, the degree of the influence on the notice nozzle is two.

(3) When the delay is introduced and the nozzles other than the notice nozzle eject the small ink drops, the degree of the influence on the notice nozzle is 0.3. When the delay is introduced and the nozzles other than the notice nozzle eject the large ink drops, the degree of the influence on the notice nozzle is 0.6.

In a case of FIG. 12A, that is, when no delays are introduced, all the nozzles of the first through third nozzle arrays eject the large ink drops, 149 of the 150 nozzles of the fourth nozzle array eject the large ink drops, and the notice nozzle ejects the small ink drop, the degree of the influence ED of the crosstalk on the notice nozzle is calculated as follows. The influence of the crosstalk when the nozzles of the first through third nozzle arrays eject the large ink drops on the notice nozzle is 300 for each array (2×150). The influence of the crosstalk when the nozzles other than the notice nozzle of the fourth nozzle array is 298 (2×149). Therefore, the degree of the influence calculated as:

$$ED=(300\times3)+298=1198$$

In a case of FIG. 12B, that is, when no delays are introduced, all the nozzles of the first through third nozzle arrays eject the small ink drops, 149 of the 150 nozzles of the fourth nozzle array eject the large ink drops, and the notice nozzle ejects the small ink drop, the degree of the influence ED of the crosstalk on the notice nozzle is calculated as follows. The influence of the crosstalk when the nozzles of the first through third nozzle arrays eject the small ink drops on the notice nozzle is 150 for each array (1×150). The influence of the crosstalk when the nozzles other than the notice nozzle of the fourth nozzle array is 298 (2×149). Therefore, the degree of the influence calculated as:

$$ED=(150\times3)+298=748$$

In each of FIGS. 13A through 15B, the degree of the influence of the crosstalk as indicated is calculated similarly.

It is understood by comparing FIG. 12A with FIG. 13A that, by introducing the delay between the nozzle array including the notice nozzle and the other nozzles, the degree of the influence of the crosstalk on the 1ch nozzle (i.e., the notice nozzle) is reduced from 1198 to 568, i.e., less than half. Thus, the influence of the crosstalk caused by the nozzles of the nozzle arrays other than one including the notice nozzle and ejecting the large ink drops on the notice nozzle which ejects the small ink drop is significantly reduced only by introducing the delay.

By comparing FIG. 12A with FIG. 14A, it is understood that, when the delay is introduced between the notice nozzle and the other nozzles in the same nozzle array, the influence of the crosstalk of the nozzles other than the notice nozzle in the same nozzle array on the notice nozzle is decreased from 1198 to 989.4. Accordingly, it is understood that it is effective to introduce the delay.

Further, by comparing FIG. 12A indicating the influence when no delays are introduced with FIG. 15A indicating the influence when the delay is introduced between the notice nozzle and the other nozzles in the same nozzle array as well as the nozzles of the other nozzle arrays, it is known that the influence of the crosstalk of the other nozzles on the notice nozzle is reduced from 1198 to 359.4, i.e., less than one-third. As is appreciated, if the delay is introduced between the notice nozzle and the other nozzles in the same nozzle array as well as the nozzles of the other nozzle arrays, the influence of the crosstalk on the notice nozzle is significantly reduced, and the small ink drop containing the accurate amount of ink can be ejected.

Further, it is known from FIGS. 12B, 13B, 14B and 15B that when all the nozzles of the first through third nozzle arrays eject the small ink drops, in comparison with a case where they eject the large ink drops, the degree of the influence of the crosstalk is reduced from 1198 to 748. When all the nozzles of the first through third nozzle arrays eject the small ink drops, the degree of the influence of all the nozzles except for the notice nozzle on the notice nozzle (1ch) is very low.

It is known, by comparing FIG. 12B with FIG. 15B, that the degree of the influence of the crosstalk of all the nozzles other than the notice nozzle on the notice pixel is reduced from 748 to 224.2, i.e., less than one-third. Thus, when the delay is introduced between the notice nozzle and the other nozzle in the same nozzle array as well as the all the nozzles in the different nozzle arrays, the influence of the crosstalk on the notice nozzle is largely reduced even in a case where the nozzles of the other nozzle arrays eject the small ink drops, the notice nozzle can eject the small ink drop containing accurate amount of ink.

FIGS. 16A and 16B, FIGS. 17A and 17B, FIGS. 18A and 18B and FIGS. 19A and 19B are tables showing the influence of the crosstalk on one nozzle (e.g., a nozzle 24-4-3) which ejects the large ink drop when only the nozzle 24-4-3 of the fourth nozzle array 24-4 ejects the small ink drop, and the remaining 149 channels of nozzles of the same array (i.e., fourth array 24-4) eject the small ink drops under various conditions.

FIGS. 16A and 16B show the influence when no delays are introduced between the pulse for the nozzle 24-4-3 (1ch) and the pulses for the other 149 nozzles (149 ch) of the fourth nozzle array 24-4. Between the pulse for the nozzle 24-4-3 and the pulses for all the nozzles in the first nozzle array 24-1 through the third nozzle array 24-3, no delays are introduced either.

FIGS. 17A and 17B show the influence when a delay is introduced between the pulse for the nozzle 24-4-3 and all the pulses for the nozzles in the first nozzle array 24-1 through the third nozzle array 24-3. No delays are introduced between the pulse for the nozzle 24-4-3 and the pulses for the other nozzles in the same nozzle array 24-4.

FIGS. 18A and 18B show the influence when a delay is introduced between the pulse for the nozzle 24-4-3 and the pulses for the other 149 nozzles of the fourth nozzle array 24-4, while no delays are introduced between the pulse for the nozzle 24-4-3 and the pulses for all the nozzles in the first nozzle array 24-1 through the third nozzle array 24-3.

FIGS. 19A and 19B show the influence when a delay is introduced between the pulse for the nozzle 244-3 and the pulses for the other 149 nozzles of the fourth nozzle array 24-4, and between the pulse for the nozzle 24-4-3 and the pulses for all the nozzles in the first nozzle array 24-1 through the third nozzle array 24-3.

It is understood by comparing FIG. 16A with FIG. 17A that, by introducing the delay between the nozzle array including the notice nozzle and the other nozzles, the degree of the influence of the crosstalk on the 1ch nozzle (i.e., the notice nozzle) is reduced from 1049 to 419, i.e., less than half Thus, the influence of the crosstalk caused by the nozzles of the nozzle arrays other than one including the notice nozzle and ejecting the large ink drops on the notice nozzle which also ejects the large ink drop is significantly reduced only by introducing the delay between arrays.

By comparing FIG. 16A with FIG. 18A, it is understood that the delay is introduced between the notice nozzle and the other nozzles in the same nozzle array, the influence of the crosstalk of the nozzles other than the notice nozzle in the nozzle array on the notice nozzle is decreased from 1049 to 944.7. Accordingly, it is understood that it is effective to introduce the delay.

Further, by comparing FIG. 16A indicating the influence when no delays are introduced with FIG. 19A indicating the influence when the delay is introduced between the notice nozzle and the other nozzles in the same nozzle array as well as the nozzles of the other nozzle arrays, it is understood that the degree of the influence of the crosstalk of the other nozzles on the notice nozzle is reduced from 1049 to 314.7, i.e., less than one-third. As is appreciated, if the delay is introduced between the notice nozzle and the other nozzles in the same nozzle array as well as the nozzles of the other nozzle arrays, the influence of the crosstalk on the notice nozzle is significantly reduced, and the large ink drop containing the accurate amount of ink can be ejected from the notice nozzle.

Further, it is known from FIGS. 16B, 17B, 18B and 19B that when all the nozzles of the first through third nozzle arrays eject the small ink drops, in comparison with a case where they eject the large ink drops, the degree of the influence of the crosstalk is reduced from 1049 to 599.

When all the nozzles of the first through third nozzle arrays eject the small ink drops, the degree of the influence of all the nozzles other than the notice nozzle on the notice nozzle that ejects the large ink drop is very low. However, it is known, by comparing FIG. 16B with FIG. 19B that the degree of the influence of the crosstalk of all the nozzles other than the notice nozzle on the notice nozzle is reduced from 599 to 179.7, i.e., less than one-third. Thus, when the delay is introduced between the notice nozzle and the other nozzle in the same nozzle array as well as all the nozzles in the different nozzle arrays, the influence of the crosstalk on the notice nozzle is largely reduced even in a case where the nozzles of the other nozzle arrays eject the small ink drops, the notice nozzle can eject the large ink drop containing accurate amount of ink.

Next, the delays to be introduced will be described in detail. FIG. 20 is a table showing exemplary delaying periods. FIGS. 21A-21D are timing charts showing the pulse signals (driving waveforms) according to the embodiment.

As described above, and is shown in FIGS. 21A-21D, a delay is introduced between the driving signals for the nozzles of the first nozzle array and the nozzles of the second through fourth nozzle arrays. Further, another delay is introduced between the driving signals for the nozzles ejecting the large ink drops and the nozzles ejecting the small ink drops within each nozzle array.

FIG. 20 indicates the values of the delay for each nozzle array when each nozzle ejects the large ink drop and small ink drop, the units of measure is μsec. According to the embodiment, from the nozzles of the first nozzle array, black ink drops are ejected. The black ink is made of pigment, has a viscosity of 3 (unit: mP·s) and surface tension of 39 (unit: mN/m). It should be noted that, since the pigment does not tend to expand on the surface of paper, which is a recording medium, even when a minute size dot is printed, the amount of the ink can be sufficiently large so that the influence of the crosstalk is unremarkable. According to the embodiment, a range of the ink amount from the small ink drop to the large ink drop is 8 through 35 picoliter.

The nozzles of the second arrays through fourth arrays 24-2 through 244 ejects color ink drops, that is, cyan, yellow and magenta ink drops, respectively. Each of the color inks is made of dye compound, and has viscosity of 3.2 mPa·s and surface tension of 33 in N/m. The ink made of dye compound tends to expand easier on the paper (which is the recording medium) in comparison with the ink made of pigment. Therefore, when a minute dot is printed, the amount of the ink drop can be small since the drop expands on the recording medium. However, since the ejection amount is small, it is easily be affected by the crosstalk. According to the embodiment, a range of the amount of cyan, yellow and magenta ink from the small ink drop to the large ink drop is 3 through 35 picoliter.

As above, the inks ejected from the nozzles of the second through fourth arrays have common characteristics. Therefore, in the first embodiment, the nozzles are categorized, by material, into a first group and a second group: the first group includes the nozzles of the first nozzle array that eject ink containing pigment (i.e., black ink); and the second group includes the nozzles of the second through fourth nozzle arrays that include ink made of dye compound. Then, the delay is introduced between the two groups. That is, the timing when the ink drops are ejected from the nozzles of the second groups is delayed with respect to the timing when the ink drops are ejected fro the nozzles of the first group.

Examples 1 and 2 of FIG. 20 indicate delaying periods according to the above-described configuration. In Example 1, with respect to a point of time when a nozzle 24 (e.g., the nozzle 24-1-1 of FIG. 11) of the first nozzle array 24-1 for ejecting the ink containing the pigment (black ink) ejects the large ink drop, the timing when the nozzles 24 of the second through fourth nozzle arrays for ejecting the ink including the dye compound (color ink) eject the large ink drops is delayed by 1 μsec.

Further, from the other nozzles (e.g., the nozzle 24-1-3 of FIG. 11), the small ink drop is ejected with a delay of 4 μsec. The timing when the nozzles 24 of the other nozzle arrays (e.g., the nozzle 244-2) eject the small ink drops is delayed by 5 μsec.

As above, a reference nozzle is discriminated from other nozzles by the viscosity or material (e.g., pigment and dye compound) of the ink to be ejected. Then, the timing at which the ejection pulse signals are applied to nozzles of the other nozzle arrays is delayed by certain amount with respect to the timing when the ejection pulse signals are applied to the nozzles of the reference nozzle array. Further, with the same nozzle array, the timing when the ejection pulse signals are applied to the nozzles that eject the small ink drops is delayed with respect to the timing when the ejection pulse signals are applied to the nozzles that eject the large ink drops.

FIGS. 21A through 21D shows the waveforms (driving pulses) realizing the ink drop ejection method indicated as Example 1 in FIG. 20.

Figures 21A, 21B, 21C, 21D:
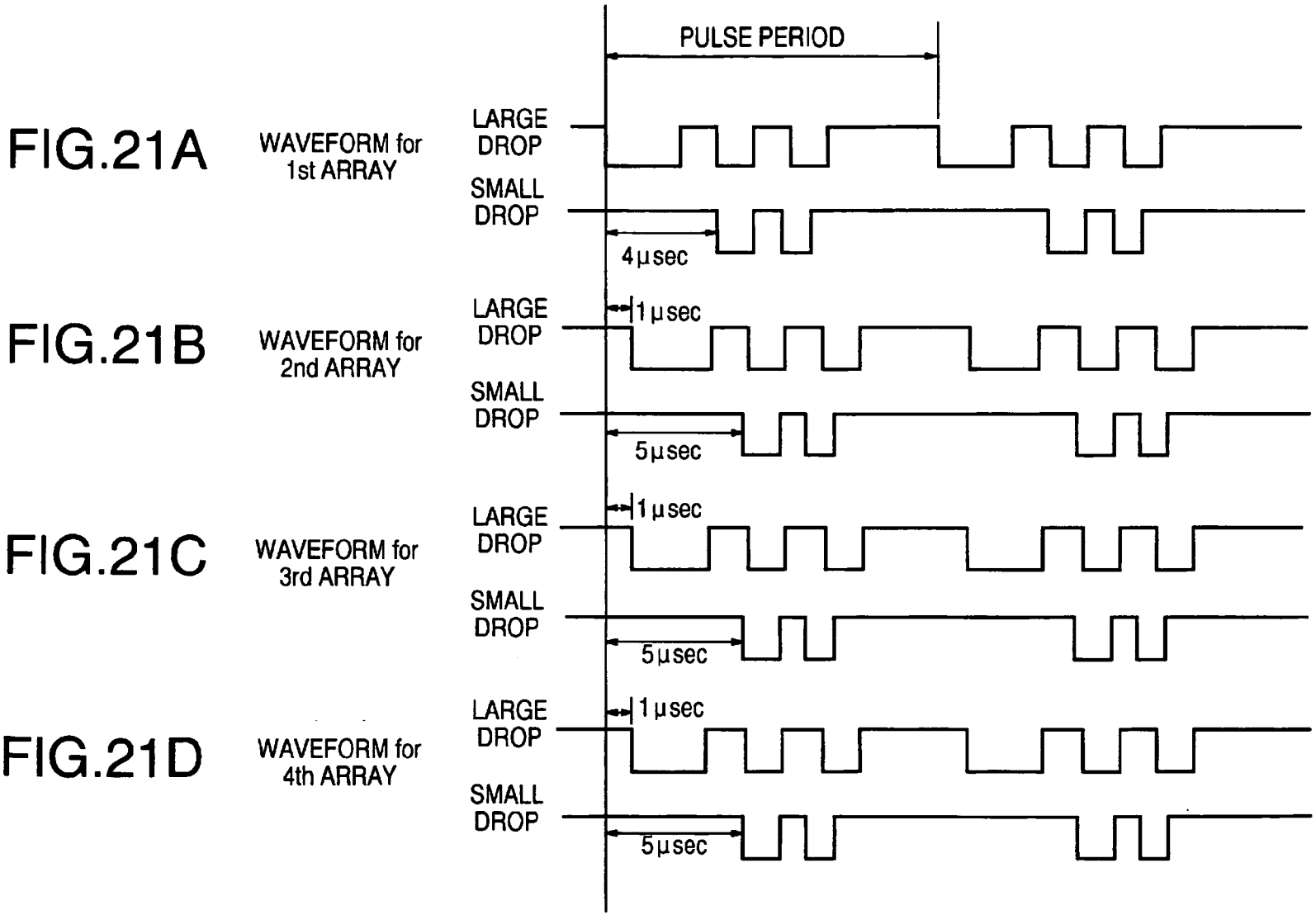
Figures 22A, 22B, 22C, 22D:
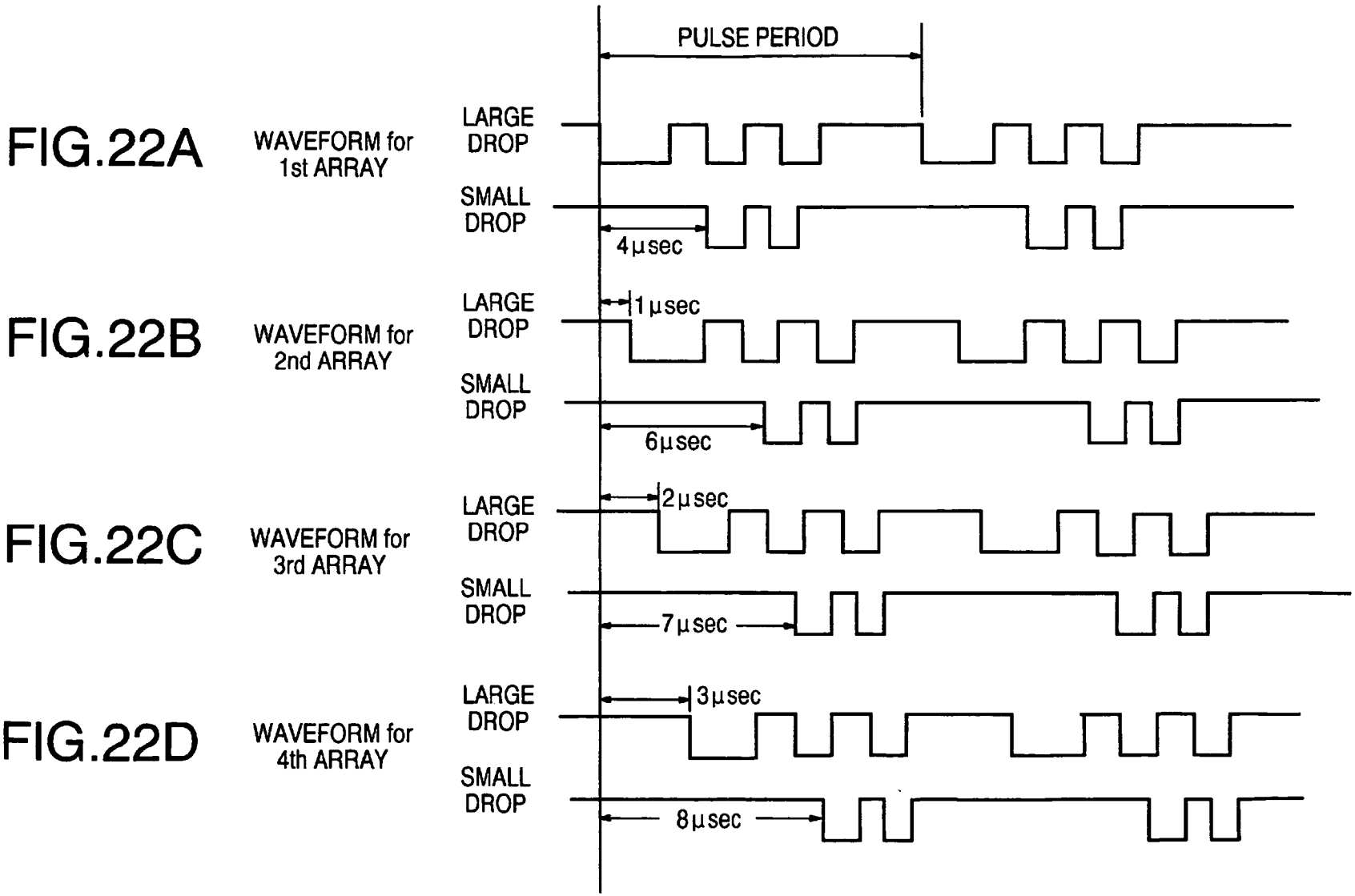

The upper waveforms shown in FIG. 21A are driving waveforms applied to the electrodes corresponding to the first nozzle arrays for ejecting black ink. The upper waveform represents the driving signal for controlling the ejection of the large ink drops containing relatively large amount of ink. The lower waveform represents the driving signal for controlling the ejection of the small ink drops containing relatively small amount of ink.

The upper waveforms shown in FIG. 21B are driving waveforms applied to the electrodes corresponding to the second nozzle arrays for ejecting cyan ink. The upper waveform represents the driving signal for controlling the ejection of the large ink drops, and the lower waveform represents the driving signal for controlling the ejection of the small ink drops.

The upper waveforms shown in FIG. 21C are driving waveforms applied to the electrodes corresponding to the third nozzle arrays for ejecting yellow ink. The upper waveform represents the driving signal for controlling the ejection of the large ink drops, and the lower waveform represents the driving signal for controlling the ejection of the small ink drops.

The upper waveforms shown in FIG. 21D are driving waveforms applied to the electrodes corresponding to the fourth nozzle arrays for ejecting magenta ink. The upper waveform represents the driving signal for controlling the ejection of the large ink drops, and the lower waveform represents the driving signal for controlling the ejection of the small ink drops.

Example 2 of FIG. 20 is a modification of Example 1. In this example, the timing at which the nozzles of the second through fourth arrays eject the small ink drops is delayed by 6 μsec. The other conditions are similar to those of Example 1. As above, the amount and speed of the ejected ink from the nozzles of the first group and second group are different regardless whether the small ink drops are ejected or the large ink drops are ejected. Therefore, ejection of the ink drops should be controlled so that they do not interfere with each other. By introducing the delay as described above, it becomes possible that the ink drops (small or large) having accurate amount of ink in accordance with the property (material, viscosity, etc.).

Example 3 of FIG. 20 represents a case where a delay is introduced between arrays, and further, in the same nozzle array, a delay is introduced between the nozzles ejecting the large ink drops and the nozzles ejecting the small ink drops.

That is, with respect to the time when the nozzles of the first nozzle array (e.g., nozzle 24-1-1 of FIG. 11) has ejected the large ink drop, the timing when the nozzles of the second nozzle array eject the large ink drops is delayed by 1 μsec., the timing when the nozzles of the third nozzle array eject the large ink drops is delayed by 2 μsec., and the timing when the nozzles of the fourth nozzle array (e.g., nozzle 24-1-3 of FIG. 11) eject the large ink drops is delayed by 3 μsec. Further, the timing when the nozzles of the first array other than the nozzles (of the first nozzle array) that have ejected the large ink drops eject the small ink drops is delayed by 4 μsec., the timing when the nozzles of the second array other than the nozzles (second nozzle array) that have ejected the large ink drops eject the small ink drops is delayed by 6 μsec., the timing when the nozzles of the third array other than the nozzles (third nozzle array) that have ejected the large ink drops eject the small ink drops is delayed by 7 μsec., and the timing when the nozzles of the fourth array other than the nozzles (fourth nozzle array) that have ejected the large ink drops eject the small ink drops is delayed by 8 μsec.

As above, in this example, the value of the delay is varied depending on whether the small ink drop is ejected or the large ink drop is ejected, and depending on the nozzle array with this configuration, the degree of influence of the crosstalk can be suppressed excellently, and the small or large ink drop containing the accurate amount of ink can be emitted from each nozzle.

FIGS. 22A through 22D shows the waveforms (driving pulses) realizing the ink drop ejection method indicated as Example 3 in FIG. 20.

The upper waveforms shown in FIG. 21A are driving waveforms applied to the electrodes corresponding to the first nozzle arrays (e.g., nozzle 24-1-1 of FIG. 11) for ejecting black ink. The upper waveform represents the driving signal for controlling the ejection of the large ink drops containing relatively large amount of ink. The lower waveform represents the driving signal to be applied to the electrodes corresponding to the first nozzle arrays (e.g., nozzle 24-1-3) for controlling the ejection of the small ink drops containing relatively small amount of ink.

The upper waveforms shown in FIG. 21B are driving waveforms applied to the electrodes corresponding to the second nozzle arrays for ejecting cyan ink. The upper waveform represents the driving signal for controlling the ejection of the large ink drops, and the lower waveform represents the driving signal for controlling the ejection of the small ink drops.

The upper waveforms shown in FIG. 21C are driving waveforms applied to the electrodes corresponding to the third nozzle arrays for ejecting yellow ink. The upper waveform represents the driving signal for controlling the ejection of the large ink drops, and the lower waveform represents the driving signal for controlling the ejection of the small ink drops.

The upper waveforms shown in FIG. 21D are driving waveforms applied to the electrodes corresponding to the fourth nozzle arrays for ejecting magenta ink. The upper waveform represents the driving signal for controlling the ejection of the large ink drops, and the lower waveform represents the driving signal for controlling the ejection of the small ink drops.

Generally, the viscosity of the ink is low when the temperature of the ink is high, and the viscosity is high when the temperature is low. At the high viscosity, channel resistance against the flow of the ink is significant. Therefore, if the ink having relatively high viscosity is ejected first, and then ink having relatively low viscosity with a certain delay, the ink can be ejected stably as a whole.

On the other hand, when the viscosity is low, formation of a meniscus in the nozzle tends to be unstable. In this regard, it is preferable that the ink having relatively low viscosity is ejected first, and then the ink having relatively high viscosity is ejected with a time delay. In such a configuration, the ink may be stably ejected.

As above, it is appropriate to categorize the nozzles in accordance with the viscosity of ink ejected therefrom.

In particular, when the viscosity of the ink is 4.5 mPa·s or more, the nozzle array that ejects the ink having the highest viscosity may be used as the reference array. By selecting the reference array in such a manner, the ink of the highest viscosity can be ejected without disturbance, and thereafter, with the delay, the ink can be ejected from the nozzles having higher stability, which contributes to stable ejection of the ink.

If the viscosity of the ink is 2.5 CPS or lower, the nozzle array that ejects the ink having the lowest viscosity may be selected as the reference nozzle array. At the low viscosity, the formation of meniscus tends to be unstable. Therefore, by ejecting the ink having the lower viscosity which is less stable than the ink having the higher stability and thereafter, with the time delay, by ejecting the ink having higher stability in forming the meniscus, the ink can be ejected stably as a whole.

It is known that the ink containing the pigment is less runny on the recording medium in comparison with the ink containing the dye compound. Therefore, if a dot of the same size is formed on the recording medium, less amount of ink is used when the ink containing the dye compound is used in comparison with the ink containing the pigment. The influence of the nozzles ejecting the large ink drops on the nozzle that ejects the small ink drop is greater as the size of the small drops is smaller. Therefore, regarding the nozzle that ejects the small ink drop, one ejects the ink containing the dye compound receives the influence more easily than one ejects the ink containing the pigment. It means that ejection of the small drops of ink containing the dye compound tends to be less stable. Therefore, by introducing a sufficiently long time delay for the ink containing the dye compound, the stability of the ink ejection can be improved.

Examples 4 and 5 of FIG. 20 indicate cases where four arrays of nozzles are arranged parallelly on the nozzle plate 14, and the arrays at both ends (i.e., first and fourth nozzle arrays) are categorized in a first group, while the two central arrays (i.e., second and third nozzle arrays) are categorized in a second group. Then the delay is introduced for the nozzles of the outer nozzle arrays (i.e., first and fourth nozzle arrays) with respect to the central nozzle arrays (i.e., second and third nozzle arrays) which are used as the reference nozzle arrays.

When a carriage provided with the above-described inkjet head, and is reciprocally moved in a direction perpendicular to a direction along which each nozzle array extends, if one outside nozzle array is define as the first nozzle array, and the other nozzle arrays are defined as second, third and fourth nozzle arrays in the order of arrangement, the first nozzle array is a top nozzle array or a last nozzle array along the moving direction of the carriage. Since the positional relationship of the reference nozzle array varies largely as the moving direction of the carriage changes, position on the recording medium at which the ink drops ejected from the nozzles with the time delays as described above arrive may shift easily.

Further, when an outer nozzle array is selected as the reference nozzle array, after the driving signal (ejection pulse) is applied to the nozzles of the outermost nozzle array, the inner nozzle array receive the influence of the crosstalk from the nozzle arrays on both sides thereof. That is, the crosstalk generated by the outer nozzle arrays affects the inner nozzle array in an overlapped manner. Such an influence occurs regardless of the reciprocal movement of the carriage.

On the contrary, if the inside array is selected as the reference nozzle array, the outer nozzle array next to the reference nozzle array only receives the influence of the cross talk directed from inside to outside due to the ink ejection by the inner nozzle arrays. Therefore, the inner nozzle array does not receive the influence of the crosstalk in an overlapped manner from two outer nozzle array. The influence of the crosstalk can easily be suppressed by introducing the delay for the inner nozzle arrays as indicated in Example 4 of FIG. 20.

The crosstalk among the nozzle arrays will be described in more detail. In this embodiment, the four arrays of nozzles are formed on the nozzle plate 14. In such a case (i.e., a plurality of arrays of nozzles are formed on the same member, or nozzle plate 14), the mechanical vibration due to the actuation of one nozzle array is transmitted to another nozzle array via the nozzle plate 14 and prevents normal ink ejection of another nozzle array.

When two nozzle arrays are driven simultaneously, corresponding amplitude of vibration occurs. The amplitude is approximately as twice as that when only one nozzle array is driven. This amplitude of vibration can be reduced by shifting driving timings of the two nozzle arrays. The degree of reduction depends on the shifting amount of the driving timings for respective nozzle arrays. For example, if the shifting amount of driving timings for two nozzle arrays coincides with a period in which the pressure wave advances and returns in the ink channel, the amplitude of the vibration may not be reduced. While, if the shifting amount of driving timings is substantially a half of the above period, the vibration of the nozzle array may be well reduced or cancelled.

Generally, when a vibration is generated from a source, it propagates toward outside in a circular pattern. If the inner two nozzle arrays are used as reference arrays (i.e., driven firstly), the two inner nozzle arrays can be regarded as a single vibration source and the vibration propagates toward outer arrays. In this case, the vibration reaches the two outer nozzle arrays at the same time. Therefore, if the outer nozzle arrays are driven at a certain timing such that the vibration caused by the inner nozzle arrays are cancelled, the crosstalk can be reduced.

On the contrary, if the outer two nozzle arrays are drive firstly, each of the outer nozzle arrays is regarded as the vibration source. In this case, for each of the inner nozzle arrays, the two vibration sources (i.e., the outer nozzle arrays) are located asymmetrically, and the vibrations reach each inner nozzle at different timings, it is relatively difficult to control the driving timing of the inner nozzle arrays so as to cancel the crosstalk. Therefore, it is preferable to use the inner two nozzle arrays as the reference nozzle arrays.

Specifically, as indicated in FIG. 20 (Example 4), with respect to the timing when the large ink drops have been ejected from the inner two nozzle arrays (i.e., second and third nozzle arrays 24-2 and 24-3), the timing when the nozzles of the nozzle arrays (i.e., first and fourth nozzle arrays) located outside the inner nozzle arrays eject the large ink drops is shifted by 1 μsec. Further, the nozzles of the reference nozzle arrays other than ones ejected the large ink drops within the reference nozzle arrays eject the small ink drops with the delay of 4 μsec. Further, the nozzles of the two outer nozzle arrays are controlled to eject the small ink drop with the delay of 5 μsec.

As explained, when the large ink drops and small ink drops are ejected, a larger delay is introduced for the outer nozzle arrays located outside the reference nozzle arrays. Further, among the nozzles of the same nozzle array, a delay is introduced. Therefore, the effects of the crosstalk when the plurality of nozzles eject the small and large ink drops in a mixed manner can be well suppressed.

Since the inner nozzle arrays are selected as the reference nozzle arrays, shift of the ink arrival positions on the medium due to the reciprocal movement of the carriage can be suppressed.

Example 5 of FIG. 20 indicates a modification of Example 4. In this example, considering the difference of material of the ink (i.e., dye compound and pigment), a relatively long delay is introduced for the signal applied to the first nozzle array (24-1) which ejects the black ink, with respect to the signal for the nozzle arrays that eject the color inks that include dye compound.

Specifically, from the nozzles of the reference nozzle arrays, the small ink drops are ejected with the delay of 6 μsec. so that the delay is introduced among the nozzles of the same nozzle array. Further, regarding one of the outer nozzle arrays, which ejects the black ink containing the pigment, the small ink drops are ejected with the delay of 5 μsec. Regarding the other one of the outer nozzle arrays, which ejects the ink containing the dye compound, the small ink drops are ejected with the delay of 7 μsec. which is 1 μsec. longer than the delay introduced for the nozzle array for the black ink. The relationship between the inner nozzle arrays and outer nozzle arrays regarding the ejection of the large ink drops is similar to that of Example 4.

As above, when the large ink drops and small ink drops are ejected, a longer delay is introduced for the nozzle arrays outside the reference nozzle arrays. Further, among the nozzles of the same nozzle array, a delay is introduced taking the material of ink into account. Therefore, even when a plurality of nozzle arrays are driven at a time and/or the small and large ink drops are to be ejected from a plurality of nozzles of the same or different nozzle arrays in a mixed manner, the influence of the crosstalk can be well suppressed even when the ink containing the pigment and the ink containing the dye compound are used at the same time.

In each of the above-described examples, the amount of the ejected ink is varied by varying the width (duration) of the ejection pulse. Therefore, it is possible to accurately constitute both the large ink drop having a relatively large amount of ink, and the small ink drop having a relatively small amount of ink. Further, the control of the amount of ink to be ejected can be achieved with a relatively simple circuit, which reduces the manufacturing cost.

It should be noted that the invention is not limited to the configurations of the above-described exemplary embodiment and various modification can be made without departing form the scope of the invention. For example, the length of the delay can be modified in various manners depending on the configuration of a printing system.

What is claimed is:

1. A method of ejecting ink drops for a printing device, the printing device having a plurality of nozzle arrays each including a plurality of nozzles arranged in a line, a plurality of pressure chambers corresponding to each nozzle of the plurality of nozzle arrays, and a piezoelectric actuator that is driven to change a capacity of each pressure chamber filled with ink to be ejected, an ink drop being ejected from each nozzle as an ejection pulse signal is applied to the piezoelectric actuator, the method comprising the steps of:

first delaying a timing at which the ejection pulse signals are applied for the nozzles of the nozzle arrays other than those of a reference nozzle array which is a predetermined one of the plurality of nozzle arrays with respect to a timing at which the ejection pulse signals are applied for the nozzles of the reference nozzle array; and second delaying a timing at which the ejection pulse signals are applied for nozzles which are to eject a relatively small amount of ink drops with respect to a timing at which the ejection pulse signals are applied for nozzles which are to eject a relatively large amount of ink drops.

2. The method according to claim 1, wherein the reference nozzle array and the other nozzle arrays are distinguished by viscosity of the inks to be ejected from respective nozzle arrays.

3. The method according to claim 2, wherein, when viscosities of all the inks are equal to or more than 4.5 mPa·s, at least one of the nozzle arrays with the nozzles ejecting the ink of the highest viscosity is selected as the reference nozzle array.

4. The method according to claim 2, wherein, when viscosities of all the inks are equal to or more than 2.5 CPS, at least one of the nozzle arrays with the nozzles ejecting the ink of the lowest viscosity is selected as the reference nozzle array.

5. The method according to claim 1, wherein the reference nozzle array and the other nozzle arrays are distinguished depending on whether the nozzles of each nozzle array eject ink containing a dye compound or ink containing pigment.

6. The method according to claim 5, wherein a nozzle array with nozzles which eject ink containing a pigment is referred to as the reference nozzle array.

7. The method according to claim 6, wherein, among the nozzles each of which ejects the relatively small amount of ink, the delay for nozzles of a nozzle array ejecting ink containing a dye compound is equal to or longer than a delay for nozzles of the nozzle array ejecting ink containing a pigment.

8. The method according to claim 1, wherein the plurality of nozzle arrays are arranged in parallel on a single ink ejection unit, the reference nozzle array being an inner nozzle array of the parallelly arranged nozzle arrays.

9. The method according to claim 1, wherein, among the nozzles of each of the nozzle arrays, a timing at which the ejection pulse signal is applied for the nozzles ejecting ink drops each having a relatively small amount of ink is delayed with respect to a timing at which the ejection pulse signal is applied for the nozzles ejecting ink drops each having a relatively large amount of ink.

10. The method according to claim 1, wherein the amount of ink ejected from each nozzle is varied by varying a duration of a pulse of the ejection pulse signal.

11. The method according to claim 10, further including steps of adding additional pulses depending on a temperature of the ink.

12. A ink drop ejecting device for a printing device, the printing device having a plurality of nozzle arrays each including a plurality of nozzles arranged in a line, a plurality of pressure chambers corresponding to each nozzle of the plurality of nozzle arrays, and a piezoelectric actuator that is driven to change a capacity of each pressure chamber filled with ink to be ejected, an ink drop being ejected from each nozzle as an ejection pulse signal is applied to the piezoelectric actuator, the ink drop ejecting device comprising:

a first delaying system that delays a timing at which the ejection pulse signals are applied for the nozzles of the nozzle arrays other than those of a reference nozzle array which is a predetermined one of the plurality of nozzle arrays with respect to a timing at which the ejection pulse signals are applied for the nozzles of the reference nozzle array; and a second delaying system that delays a timing at which the ejection pulse signals are applied for nozzles which are to eject a relatively small amount of ink drops with respect to a timing at which the ejection pulse signals are applied for nozzles which are to eject a relatively large amount of ink drops for each nozzle array.

13. The ink drop ejecting device according to claim 12, wherein the plurality of nozzle arrays are arranged in parallel on a single ink ejection unit, the reference nozzle array being an inner nozzle array of the parallelly arranged nozzle arrays.

14. The ink drop ejecting device according to claim 13, wherein the plurality of nozzle arrays comprise four nozzle arrays, the reference nozzle array comprising two central nozzle arrays of the four nozzle arrays.

15. A computer program product comprising computer accessible instructions defining a method of ejecting ink drops for a printing device, the printing device having a plurality of nozzle arrays each including a plurality of nozzles arranged in a line, a plurality of pressure chambers corresponding to each nozzle of the plurality of nozzle arrays, and a piezoelectric actuator that is driven to change a capacity of each pressure chamber filled with ink to be ejected, an ink drop being ejected from each nozzle as an ejection pulse signal is applied to the piezoelectric actuator, the instructions comprising the steps of:

first delaying a timing at which the ejection pulse signals are applied for the nozzles of the nozzle arrays other than those of a reference nozzle array which is a predetermined one of the plurality of nozzle arrays with respect to a timing at which the ejection pulse signals are applied for the nozzles of the reference nozzle array; and second delaying a timing at which the ejection pulse signals are applied for nozzles which are to eject a relatively small amount of ink drops with respect to a timing at which the ejection pulse signals are applied for nozzles which are to eject a relatively large amount of ink drops for each nozzle array.

16. The computer program product according to claim 15, wherein the reference nozzle array and the other nozzle arrays are distinguished by viscosity of the inks to be ejected from respective nozzle arrays.

17. The computer program product according to claim 16, wherein viscosities of all the inks are equal to or more than 4.5 mPa·s, at least one of the nozzle arrays with the nozzles ejecting ink of the highest viscosity is selected as the reference nozzle array.

18. The computer program product according to claim 16, wherein viscosities of all the inks are equal to or more than 2.5 CPS, at least one of the nozzle arrays with the nozzles ejecting the ink of the lowest viscosity is selected as the reference nozzle array.

19. The computer program product according to claim 15, wherein the reference nozzle array and the other nozzle arrays are distinguished depending on whether the nozzles of each array eject ink containing a dye compound or ink containing pigment.

20. The computer program product according to claim 19, wherein a nozzle array with nozzles which eject ink containing a pigment is referred to as the reference nozzle array.

* * * * *